US008998070B2

(12) United States Patent
Wisecarver

(10) Patent No.: US 8,998,070 B2
(45) Date of Patent: Apr. 7, 2015

(54) BULK CONTAINER WITH BAG LINER SECURED IN PLACE

(71) Applicant: International Paper Company, Memphis, TN (US)

(72) Inventor: Mark Anthony Wisecarver, Morristown, TN (US)

(73) Assignee: International Paper Company, Memphis, TN (US)

( * ) Notice: Subject to any disclaimer, the term of this patent is extended or adjusted under 35 U.S.C. 154(b) by 122 days.

(21) Appl. No.: 13/868,658

(22) Filed: Apr. 23, 2013

(65) Prior Publication Data

US 2013/0277419 A1 Oct. 24, 2013

Related U.S. Application Data

(60) Provisional application No. 61/636,844, filed on Apr. 23, 2012.

(51) Int. Cl.

| | |
|---|---|
| ***B65D 5/56*** | (2006.01) |
| ***B65D 19/00*** | (2006.01) |
| ***B65D 5/02*** | (2006.01) |
| ***B65D 5/10*** | (2006.01) |
| ***B65D 5/60*** | (2006.01) |

(52) U.S. Cl.

CPC ..... *B65D 5/56* (2013.01); *B65D 19/0095* (2013.01); *B65D 5/029* (2013.01); *B65D 5/106* (2013.01); *B65D 5/60* (2013.01); *B65D 2519/00273* (2013.01); *B65D 2519/00293* (2013.01); *B65D 2519/00323* (2013.01); *B65D 2519/00333* (2013.01); *B65D 2519/00378* (2013.01)

(58) Field of Classification Search

USPC ..... 229/109, 117.27, 117.3, 117.32, 229/117.35; 220/495.06; 53/175; 493/95, 493/100

See application file for complete search history.

(56) References Cited

U.S. PATENT DOCUMENTS

| | | | | |
|---|---|---|---|---|
| 3,549,081 | A | 12/1970 | Nelson | |
| 4,702,408 | A * | 10/1987 | Powlenko | 229/109 |
| 4,919,301 | A * | 4/1990 | Miller | 220/200 |
| 4,919,306 | A * | 4/1990 | Heaps et al. | 222/105 |
| 5,125,565 | A | 6/1992 | Rogers | |
| 5,427,267 | A * | 6/1995 | Willman | 229/117.35 |
| 5,803,302 | A * | 9/1998 | Sato et al. | 229/117.3 |
| 5,944,251 | A | 8/1999 | Lafleur | |
| 6,386,437 | B1 | 5/2002 | Larson, Jr. | |
| 6,415,927 | B1 | 7/2002 | Stone et al. | |
| 6,588,651 | B2 | 7/2003 | Quaintance | |
| 6,688,514 | B2 * | 2/2004 | Evans et al. | 229/109 |
| 6,783,058 | B2 | 8/2004 | Quaintance | |
| 7,654,440 | B2 | 2/2010 | Quaintance et al. | |
| 7,681,781 | B2 | 3/2010 | Wisecarver | |
| 2009/0114311 | A1 * | 5/2009 | McDowell | 220/495.06 |
| 2011/0017731 | A1 * | 1/2011 | Taravella et al. | 220/4.28 |

FOREIGN PATENT DOCUMENTS

| | | |
|---|---|---|
| DE | 1060310 | 6/1959 |

* cited by examiner

*Primary Examiner* — Gary Elkins
(74) *Attorney, Agent, or Firm* — Matthew M. Eslami

(57) ABSTRACT

A bulk container for shipping product in bulk from one location to another location, wherein the container has a sidewall with a top end and a bottom end, a bottom closure at the bottom end of the sidewall closing the bottom end of the container, a bag liner in the container, and attaching structure on the bottom closure for attaching the bottom end of the bag liner to the bottom end of the container so that the bag liner remains in the container when the container is inverted and product is dumped from the container.

26 Claims, 15 Drawing Sheets

BULK CONTAINER WITH BAG LINER SECURED IN PLACE

FIELD OF THE INVENTION

This invention relates generally to containers for bulk shipping of product. More particularly, the invention relates to a bulk container having a bag liner for containing flowable product, wherein the bag liner at its bottom end is attached to the bottom end of the container to prevent the liner from falling out of the container when the container is inverted to dump out the product.

BACKGROUND OF THE INVENTION

Bulk containers used in the industry for storing and shipping numerous products typically hold 2,000 pounds or more of the product, including flowable or semi-liquid products such as, e.g., comminuted poultry. The containers are commonly made of corrugated cardboard and comprise a plurality of sidewalls joined together along vertical folds. The bottoms of the containers preferably are closed or partially closed by inwardly folded bottom flaps joined to bottom edges of the side walls along horizontal folds. The flaps are separated from one another by slots or cuts extending from an outer edge of the flaps to a point at or near the intersection of the vertical and horizontal folds.

Bulk containers made of corrugated material are typically manufactured from a single blank that is scored to delineate the sidewalls, end walls, diagonal corner panels, and bottom flaps. The blank is folded and secured at a manufacturer's joint by the manufacturer, and shipped to the user in a flattened condition. The user then sets the flattened container on end and opens it up into an expanded tubular configuration. The bottom flaps are then folded inwardly and secured to hold the container in its set-up condition. Self-locking bottom flaps have been developed to facilitate setting up the container from its flattened condition to its fully open usable condition.

Bulk packaging containers often require a plastic bag liner to contain flowable product and/or to protect the product from contamination. These containers are often emptied using dumping equipment that lifts and inverts the container over a vat or storage bin. It is common for the plastic bag to follow the product out of the bulk container toward the vat. It is important that the bag does not get into the vat as it will be caught up in the processing equipment and contaminate the product. The plastic bag, therefore, is made to extend beyond the depth of the container, allowing the top end of the bag to drape over the sides of the container top end where it can be taped or stretch-wrapped to the container, prohibiting the bag from falling into the vat. However, the plastic bag still follows the product out of the container, but a distance is provided between the inverted container and the vat to prevent the bag from extending into the vat as long as the tape or stretch film holds the bag. In spite of this precaution, there are certain container depths and bag lengths which can cause issues where the bag can extend into the vat and get caught up in the equipment. Further, if the bag is not draped over and secured at the correct length, it can get into the equipment and contaminate the product. Bags are colored to help detect bag pieces in product during processing. Contamination causes significant product loss and down time. The cost associated with the plastic bag getting into the vat equipment can be substantial, with each incident costing thousands of dollars. The cost includes contaminated product, down time, labor to clean the system, and equipment repair.

Moreover, in conventional systems the bag can inadvertently be placed incorrectly in the container causing capacity loss, and more importantly, bag rupture and container failure. The bulk containers are usually rectilinear in shape, i.e. either rectangular or octagonal, and the bag is designed to accommodate the size and shape of the container. If the bag is placed in the wrong orientation in the container, i.e., with a wide dimension of the bag width aligned with a narrow dimension of the container width, the bag will not open properly and will cause void areas, cavities, and pockets to form during filling of the bag, preventing product to fill those areas and thereby reducing capacity. Also, the product will continuously apply pressure to the bag in those areas and potentially rupture the bag. Once this occurs, the product, often containing water or other liquid, will escape from the bag into the container. At that point, corrugated containers are subject to failure due to water saturation.

Further, if the bag is not properly opened within the container prior to being filled the results can be the same as when the bag is oriented incorrectly in the container as described above. If the bag is not allowed to reach and extend across the bottom of the container the bag can be stretched to the point of rupture. If the bag is not properly opened up prior to filling, air pockets can form, creating rupture points. Ruptures cause leakers that weaken the container potentially to failure.

It would be desirable to have a bulk container that is free of the problems associated with conventional bulk containers, and particularly to have an octagonal bulk container having a bag liner attached to the bottom of the container so that the bag is retained in the container until it is desired to remove it.

SUMMARY OF THE INVENTION

The present invention solves the aforementioned problems by securing the bottom of the bag to the bottom of the container, thereby preventing the bag from following the product out of the container when it is inverted and the product dumped out. Attaching the bag as contemplated by the invention also ensures proper orientation of the bag in the container and filling of it. The bottom of the bag can be secured to the bottom of the container in any suitable manner, such as by using tape, double face tape, laminating the bag to the container using adhesives, and the like. In preferred embodiments, the bottom of the bag is secured to the bottom of the container using die-cut self-locking features in a bottom flap of the container. The self-locking features can be holes or slits or a combination of holes and slits through which the bottom corners of the plastic bag are inserted and secured.

In a broad aspect, the invention comprises a bulk container for shipping product in bulk from one location to another location, wherein the container has a top end and a bottom end and comprises a sidewall having a top end and a bottom end, bottom closure means at the bottom end of the sidewall closing the bottom end of the container, a bag liner in the container, said bag liner having a top end at the top end of the container and a bottom end at the bottom end of the container, and attaching means on the bottom closure means for attaching the bottom end of the bag liner to the bottom end of the container so that the bag liner remains in the container when the container is inverted to dump product from the bag liner.

Although the invention is illustrated and described with particularity herein as applied to a bulk container having multiple sidewalls and end walls and closed at its bottom end by foldable flaps, it is intended that the principles of the invention could be applied to other types of bulk containers, such as, e.g., a drum wherein the sidewall is cylindrical and a disc-shaped bottom is attached to the bottom end to close it. In that event, adhesive or tape or other suitable fastening means could be used to attach the bottom end of the bag to the bottom of the container. Accordingly, unless otherwise indicated by the specifics of appended claims, such a structure is intended to be covered by the present invention.

According to one preferred embodiment of the invention, the container is polygonal in transverse cross section and has opposite sidewalls and end walls and bottom flaps closing the bottom end of the container. The die-cut self-locking feature comprises a hole and an associated slit extending into one side of the hole in each of two opposite corners of a major bottom flap of the container. Opposite corners of the bottom of the bag are inserted through a respective hole and pulled into the associated slit, locking the bag corners to the self-locking die-cut features and thus to the bottom of the container.

According to another preferred embodiment, the die-cut self-locking feature comprises two adjacent holes in each of two opposite corners of a major bottom flap, and opposite bottom corners of the bag are inserted through one hole, back through the adjacent hole, and tied, securing the bottom corners of the bag to the bottom of the container.

In another preferred embodiment, a slit extends into each of two opposite side edges of a major bottom flap and opposite corners of the bottom of the bag are pulled into respective slits to secure the bottom of the bag to the bottom of the container.

To secure the bag to the container, the container is placed in an inverted position with its bottom end up and the major bottom flaps unfolded. A bag designed to fit the container is then placed into the container through the container bottom. The corners of the bag at the bottom seam are each placed in a respective die-cut self-locking feature at opposite ends of one of the major bottom flaps. This ensures that the bag is in proper orientation in the container. The container is then opened up into its use configuration and placed in an upright position, after which the bag is opened up fully inside the container, ensuring that it is properly opened without voids or pockets that would otherwise prevent the bag from filling properly. Attachment of the bottom of the bag to the container bottom enables the bag to be filled with product without the formation of voids or pockets.

When the container arrives at its final destination and is emptied via dumping equipment, the bag will remain in the container, preventing the bag from getting into the vat and causing contamination of the product and equipment problems. This also makes it easier to retrieve the bag for disposal. These features potentially result in substantial cost savings. The self-locking feature of the invention is user friendly, secures the plastic bag in a correct position, and aids in opening the bag properly prior to filling the bag with product. This reduces the chance of bag ruptures that can lead to container failures, which can result in thousands of dollars of product loss, labor and clean up expense.

Another advantage is that the container of the present invention is designed to perform in wet environments without adverse effect to the integrity of the container, including to a certain extent, containers that get wet from leaking bags. Reducing the occurrence of leaking bags can allow for container optimization, which can provide cost savings for customers purchasing the containers.

One example of a bulk container in which the die-cut quick-lock feature of the present invention can be incorporated is disclosed in applicant's prior U.S. Pat. No. 7,654,440, the disclosure of which is incorporated in full herein by reference and generally repeated herein.

In accordance with the present invention, the die-cut quick-lock feature comprising holes or slits or a combination of holes and slits that receive the bottom corners of the bag liner as described above are formed in the extensions on opposite side edges of one of the major bottom flaps of the container. The container is octagonally shaped and is erected from a single unitary blank with opposed sidewalls, opposed end walls, and diagonal corner walls or panels interposed between adjacent side and end walls, the walls being connected together along vertical folds at their adjacent side edges. The sidewalls generally have a greater width than the end walls, and in a preferred embodiment the end walls and diagonal walls have the same width, thus reducing the width of the sidewalls and end walls in a container having a comparable capacity, and thereby reducing outward bulge of the sidewalls and/or end walls, although the invention has equal applicability in a container having diagonal walls that are narrower than the end walls.

A major bottom flap is foldably joined to the bottom edge of each sidewall, a minor bottom flap is foldably joined to the bottom edge of each end wall, and a diagonal bottom flap is foldably joined to the bottom edge of each diagonal wall, these flaps being foldably joined to the respective walls along horizontal folds substantially perpendicular to the vertical folds. The major and minor flaps typically have the same width (as used herein with reference to the flaps, "width" refers to the distance between the free edge of the flap and its folded connection with a respective wall), but the width of the diagonal flaps is substantially less. The major flaps have a longitudinal end edge and generally trapezoidally shaped extensions projecting from opposite side edges thereof. The extensions are separated from adjacent diagonal flaps by angled cuts extending from an outer edge of a respective diagonal flap to a point near the juncture of an adjacent vertical fold and the horizontal fold for that major flap. Material is cut from between adjacent side edges of the major and minor flaps in the area located beyond the free edge of an associated diagonal flap so that these edges are spaced from one another.

The bottom flaps in the container of the invention are self-locking, and web panels are connected between adjacent edges of the diagonal flaps and the respective adjacent minor bottom flaps, whereby the diagonal flaps automatically fold inwardly when the minor flaps are folded in, so that the user has to fold only four bottom flaps inwardly (the two major flaps and the two minor flaps), in contrast to the requirement to fold eight bottom flaps inwardly on conventional octagonal containers (the two major flaps, the two minor flaps, and four diagonal flaps).

Since the major flaps in the container of the invention are separated from adjacent diagonal flaps by cuts, the major flaps can be folded inwardly independently of movement of the diagonal flaps or minor flaps, making the major flaps easier to fold and avoiding tearing of the diagonal flap panels due to stress imposed on them by folding of the major flaps, as occurs in those constructions in which the major flaps are connected by a gusset or web panel to the diagonal flaps. Further, the cuts or slits separating the major bottom flaps from adjacent diagonal flaps terminate in spaced relationship to the horizontal and vertical folds delineating the side walls, thereby eliminating the weak points where tearing of the vertical folds can initiate.

The construction and sequence of folding of the bottom flaps also avoids the formation of pinch points, since the diagonal flap panels are disposed between the major flaps and the minor flaps and none of the diagonal panels are exposed inside the container. In conventional constructions the diagonal flaps can be disposed above the major flaps and inside the container, forming potential pinch points that can cause tearing of a bag placed inside the container to contain products having greater fluidity.

Notches cut in the ends of the minor bottom flaps form a pair of locking tabs on each minor bottom flap, and angled slots cut in the major bottom flaps adjacent their outer edge form openings for receiving the locking tabs. The two major bottom flaps are first folded inwardly to square up the container, followed by inward folding of the minor bottom flaps. Since the diagonal flaps are connected by web panels or gussets to adjacent edges of the minor bottom flaps, inward folding of the minor bottom flaps into their operative inwardly folded position also causes the diagonal flaps to fold inwardly, with a portion of the diagonal flaps sandwiched between the major and minor flaps. By pressing the inwardly folded minor flaps downwardly against the previously inwardly folded major flaps, the locking tabs on the minor bottom flaps engage in the slots in the major bottom flaps to lock the bottom flaps in position and thus hold the container in its setup condition.

In one embodiment of the container in which the present invention can be incorporated, the major bottom flaps can have a combined width slightly greater than the width of the container so that the major flaps overlap at their free edges when they are fully inwardly folded to close the bottom of the container. The notches cut in the ends of the minor flaps are shaped so that when the minor flaps are pressed down against previously folded major flaps during set up to insert the locking tabs into the slots, and then released to enable the flaps to spring back up to a generally horizontal, interlocked position, clearance is provided to enable one major flap to rise above the other so that one of the major flaps will overlie the other as they return to their interlocked horizontal position. Without this feature, it is possible for the free edges of the major flaps to about one another when pressure is released, preventing the overlap and causing the abutting major flaps to tend to spread apart the bottom of the container.

In another embodiment of a container that can incorporate the die-cut self-lock feature of the invention, the major bottom flaps do not overlap but instead have a combined width substantially equal to the width of the container and butt against one another at their free edges when they are in their inwardly folded, generally horizontal positions. In these containers the notches in the free edges of the minor flaps can be identical, mirror images of one another so that when downward pressure against the minor flaps is released, both major flaps spring upward equally so that when the flaps return to a generally horizontal position the free edges of the major flaps abut one another, effectively closing the bottom of the container. To facilitate predetermined folding of the diagonal flaps, a strategically placed angled fold score is made in the diagonal flaps, extending from a point near where the vertical and horizontal folds for the adjacent minor flap intersect to the end of the cut-out that separates the major and minor flaps. In accordance with the present invention, holes or slits or a combination thereof are formed in the extensions at opposite sides of one of the major bottom flaps.

The diagonal flaps and portions of the minor flaps are crushed in a predetermined pattern to provide clearance for the overlapping flap material when the flaps are operatively engaged to close the bottom of the container, and to prevent formation of false scores or folds as the flaps are folded inwardly. More specifically, all of the material of the diagonal flap lying between the angled fold score and the angled cut separating diagonal flap from the adjacent major flap is lightly crushed, and the balance of the diagonal flap and a portion of the adjacent minor flap is more heavily crushed, with the edge of the crushed area lying in the minor flap having an arcuate shape.

Further, in a preferred form of the container in which the present invention can be incorporated, a parabolic crease or score is made in each sidewall in a top portion thereof to produce predictable and controlled buckling or bulging of the sidewall as the result of pressure exerted on the sidewalls by product in the container.

The bulk container can be of single wall, double wall or triple wall construction, with or without sesame tape or strap reinforcing, and stretch wrap can be easily applied.

The bulk container can be used with a conventional wooden pallet, or a slip sheet, or can be set directly on a floor surface. Further, applicant has developed a plastic pallet tray for use with octagonal bulk containers, and especially when this pallet tray is used with the bulk container of the invention it is contemplated that the containers can be stacked on top of one another, something that cannot be done with conventional octagonal bulk containers. Moreover, the plastic pallet tray serves as a jig to facilitate setup of the octagonal bulk container, and prevents contact between the top of the container and a floor surface, thereby reducing or eliminating contamination issues. The pallet tray is lightweight and nestable for economy in storage and shipping, is reusable, and has two-way accessibility for a hand jack and four-way accessibility for a fork lift. Although shown and described herein as used with the octagonal bulk container, it should be understood that with appropriate modification the plastic pallet tray can be used with four-sided containers.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1:
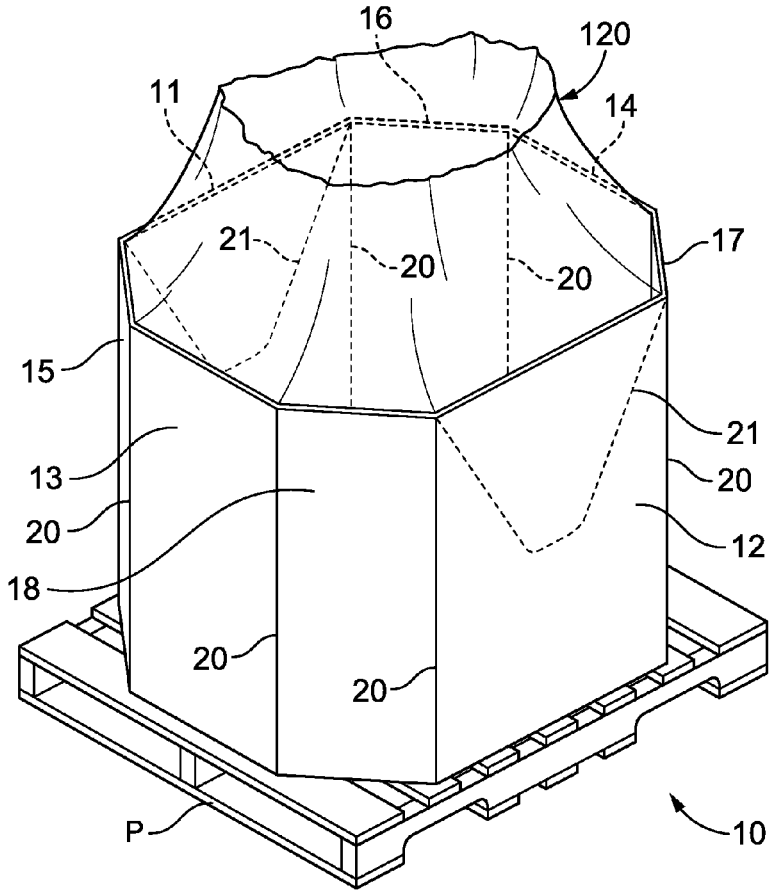
FIG. 1 is a top perspective view of one embodiment of an octagonal bulk container having a plastic bag attached thereto in accordance to a preferred embodiment of the invention.
Figure 2:
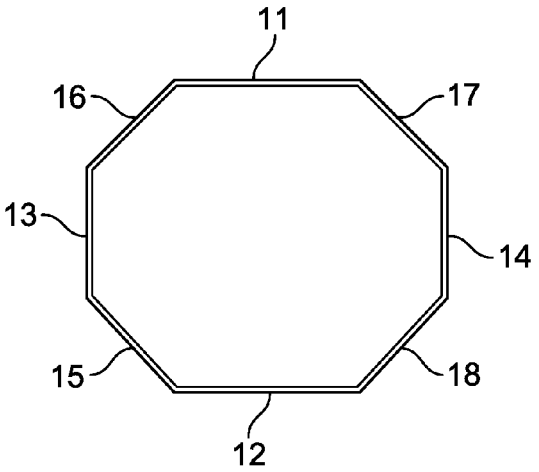
FIG. 2 is a plan view of the footprint of a container wherein the end walls and diagonal corner panels have the same width.
Figure 3:
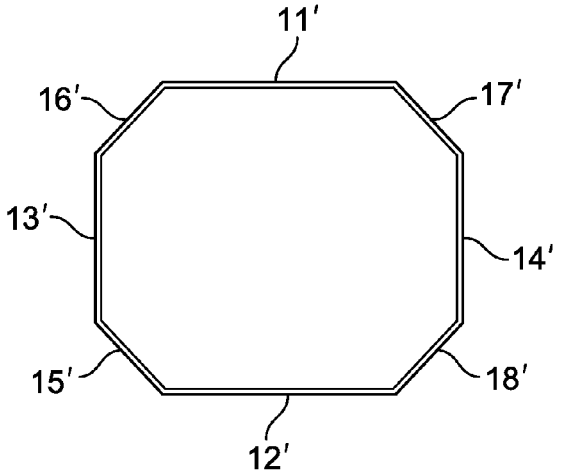
FIG. 3 is a plan view of the footprint of a container wherein the diagonal corner panels have less width than the end walls.

An octagonal bulk container in which the present invention can be incorporated is indicated generally at 10 in FIG. 1, and comprises opposite parallel sidewalls 11 and 12, opposite parallel end walls 13 and 14, and diagonal corner panels 15, 16, 17 and 18 interposed between respective side and end walls. The side and end walls and the diagonal corner panels are joined along vertical folds 20. In the preferred embodiments, shown, e.g., in FIGS. 1, 2, 4, 12 and 14-16, the diagonal corner panels 15-18 have the same width as the end walls 13 and 14, and parabolic creases 21 are formed in the sidewalls 11 and 12 to obtain predictable and controlled buckling of the sidewalls when internal pressure is applied to the sidewalls by the contents of the container. As shown in the particular embodiments described herein, the creases 21 are formed by a score line bordered by crushing on both sides. The operation of the creases 21 and of the equal width end walls and diagonal corner panels is more fully explained in applicant's prior U.S. Pat. Nos. 6,783,058 and 7,654,440. It should be understood, however, that neither equal width end walls and diagonal corner panels, nor the parabolic creases are essential to the present invention, but either or both do enhance performance of the container. Further, the container in FIG. 1 is shown as supported on a conventional wooden pallet P, but it should be understood that a pallet such as shown in applicant's prior U.S. Pat. No. 7,681,781 could be used. The type of pallet, or whether any pallet is used, is not important to the present invention.

According to the present invention, a plastic bag liner 120 is placed in the bulk container 10 and is attached to the bottom of the container in a manner so that during dumping of the contents of the bag 120, the bag 120 remains securely attached to the container and does not fall from the container into a vat (not shown) receiving the product.

Figure 4:
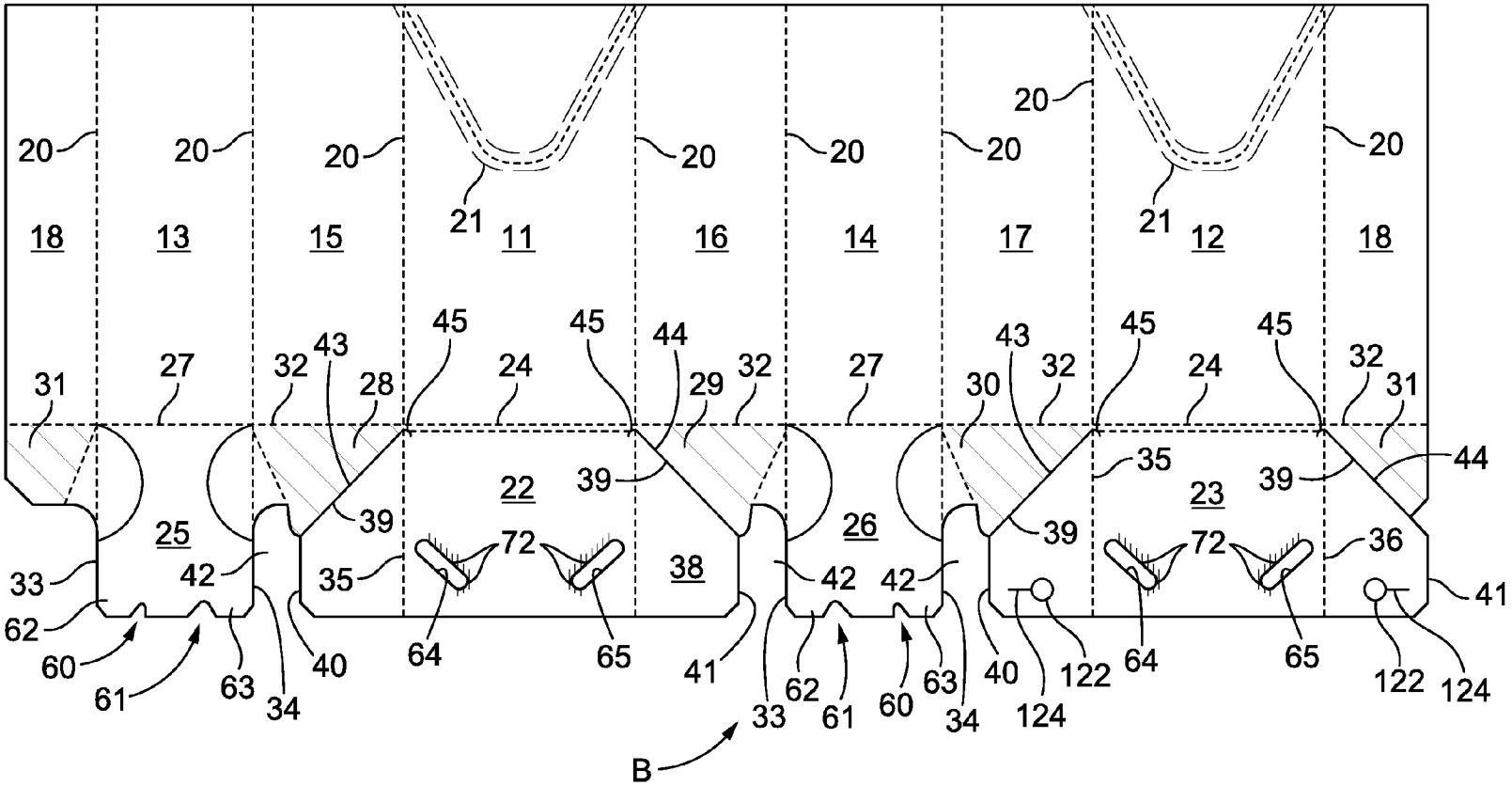
FIG. 4 is a plan view of a blank having a first form of die-cut self-lock feature according to the invention, wherein a combination of a hole and a slit are provided in the extensions projecting from opposite side edges of one of the major bottom flaps for tying the plastic bag thereto and making the bulk container shown in FIG. 1.

FIG. 4 is a plan view of a blank B for making a container as shown in FIG. 1, wherein the blank incorporates on one of the major bottom flaps that embodiment of die-cut self-lock feature of the invention that comprises a combined hole or opening 122 and a slit 124 for attaching the bottom corners of the plastic bag liner to the bottom of the container. The blank B is substantially symmetrical with respect to its lateral axis and preferably comprises a single unitary piece of a material such as a continuous sheet of conventional corrugated cardboard. The blank B is cut along its outer margins to form its specific shape.

With reference to FIG. 4, major bottom flaps 22 and 23 are foldably joined to bottom edges of the respective sidewalls 11 and 12 along horizontal folds 24 extending perpendicular to the vertical folds 20, minor bottom flaps 25 and 26 are foldably joined to bottom edges of respective end walls 13 and 14 along horizontal fold lines 27, and diagonal bottom flaps 28, 29, 30 and 31 are joined to respective diagonal corner panels 15, 16, 17 and 18 along horizontal folds 32. The major and minor bottom flaps are equally wide between their respective folds and free edges, and have lengths in a side-to-side direction that correspond to the width of a respective sidewall or end wall, with the minor flaps 25 and 26 having opposite side edges 33 and 34 aligned with the vertical folds 20 delineating a respective associated end wall, and the major flaps 22 and 23 having opposite sides defined by creases 35 and 36 aligned with the vertical folds 20 delineating a respective sidewall. Thus, in an octagonal container having sidewalls that are wider than the end walls, as in the embodiments shown herein, the major bottom flaps are longer side-to-side than the minor bottom flaps. Further, the diagonal bottom flaps 28, 29, 30 and 31 have a width between their respective folds 32 and free edges that, in the particular embodiments shown, is less than about ½ the width of the major and minor flaps. It should be noted that this dimensional relationship is at least partially dependent upon the respective widths of the sidewalls, end walls and diagonal corner panels, and can vary depending upon this and other factors.

The major bottom flaps 22 and 23 have trapezoidally shaped extensions or wings 37 and 38 projecting laterally from the creases 35 and 36 at opposite side edges of the flaps, and the extensions are separated from respective adjacent diagonal flaps 28, 29, 30 or 31 by cuts 39 extending at about a 45° angle from a point near the intersection of the folds 24 with a respective crease 35 or 36, to a point about mid way along the opposite side edges 40 and 41 of the major flap extensions, and by shaped cut-outs 42 that space edges 40 and 41 from adjacent edges 33 and 34 of the minor flaps. The side edges of the major flaps therefore include edge portions 43 and 44 that extend at about a 45° angle relative to vertical folds 20 and edge portions 40 and 41 that extend parallel to vertical folds 20.

In the embodiment shown in FIG. 4, that embodiment of die-cut self-lock feature comprising a combined hole 122 and slit 124 is formed in each of the extensions 37 and 38 on opposite side edges of one of the major bottom flap 23. The slit 124 extends through the free edge of the respective extension 37 or 38 from one side of the hole or opening 122. The cuts 39 terminate in a J-shaped hook 45 at their ends adjacent but spaced a slight distance "d" from the folds 24 and pointing away from both the horizontal and vertical folds, thereby redirecting stress away from the lower end of the vertical folds 20 to avoid initiation of a tear in the vertical fold. While superior performance is obtained with the J-shaped cut shown, it is to be understood that other shapes could be employed, so long as stress along cut 39 is redirected away from the horizontal fold 24 and especially away from the vertical fold 20. For example, the cut could be shaped as a modified Greek letter psi, or an inverted modified Greek letter psi, or a T, L, U, V, etc as described in applicant's commonly owned prior U.S. Pat. No. 7,681,781.

Figure 11:
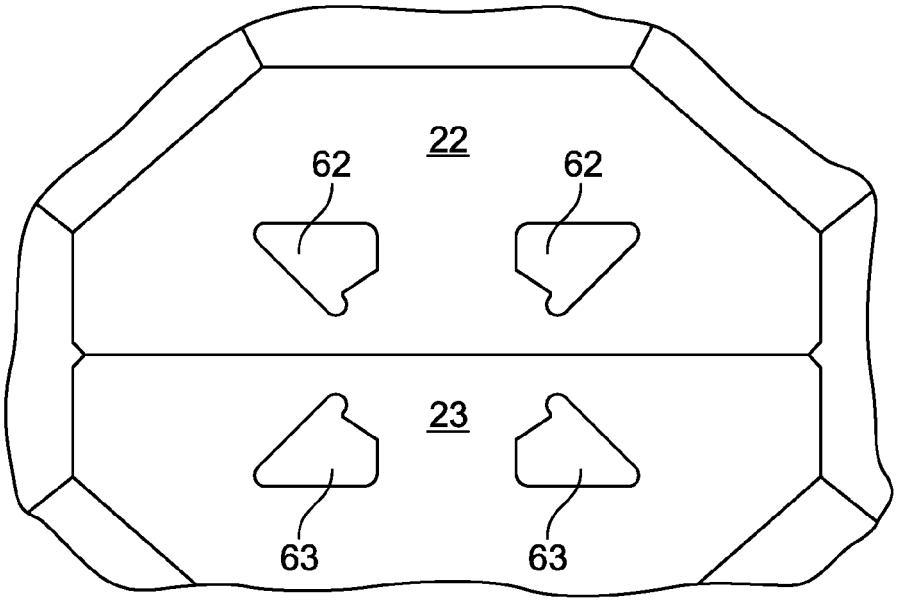
FIG. 11 is a plan view of the interior bottom of the container of FIG. 10, showing the relatively flat interior bottom surface, with the only members projecting into the interior comprising the locking tabs.

The length of the extensions 37 and 38 between the creases 35 and 36 and the edges 40 and 41, and the shape of the extensions as defined by the cuts 39 and cut-outs 42, are such that the extensions closely fit in the interior space or corners of a container erected from the blanks shown in the figures. See, e.g., FIGS. 7 and 11.

Figure 5:
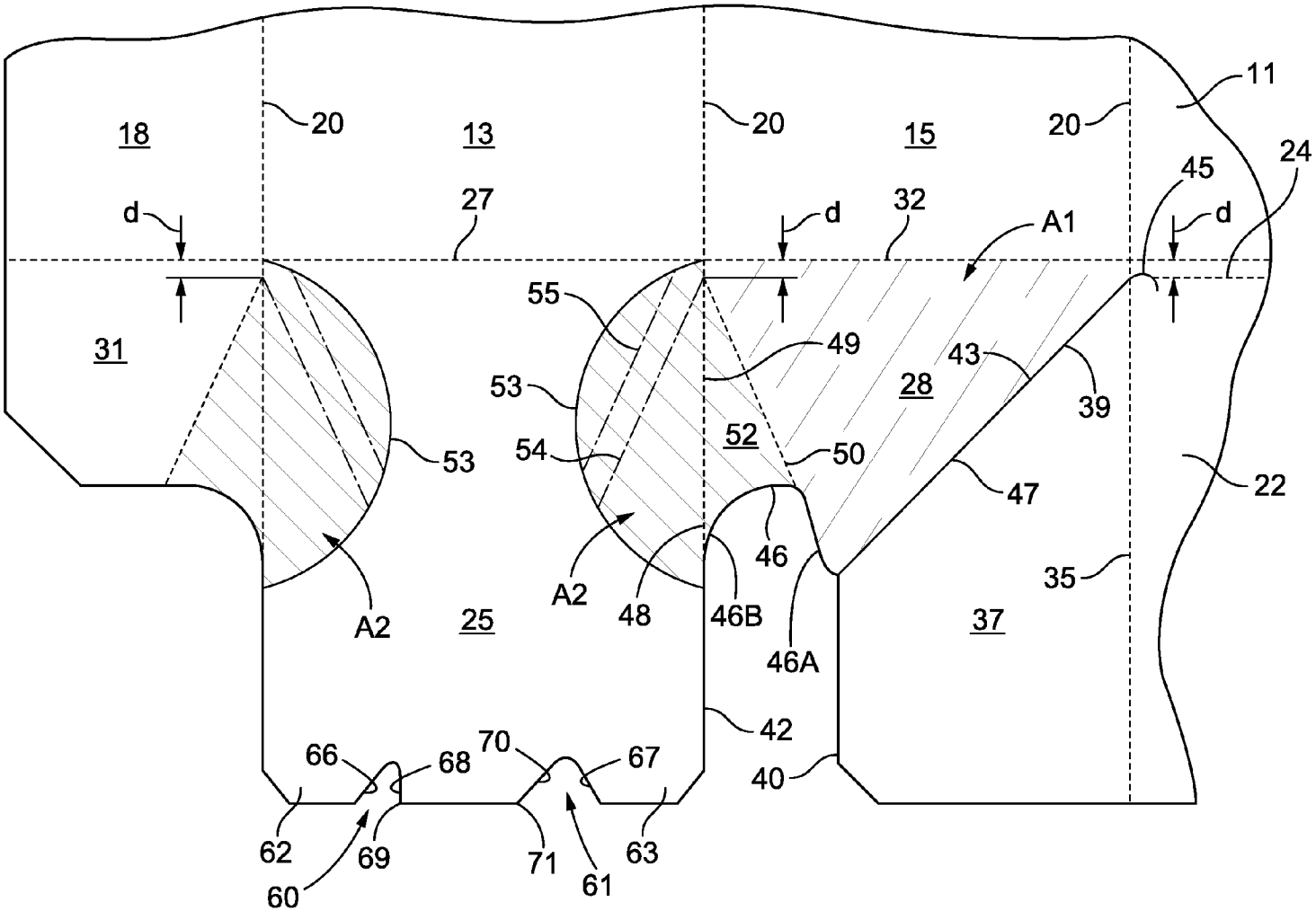
FIG. 5 is an enlarged fragmentary plan view of a portion of the blank of FIG. 4, showing details of the invention.
Figure 6:
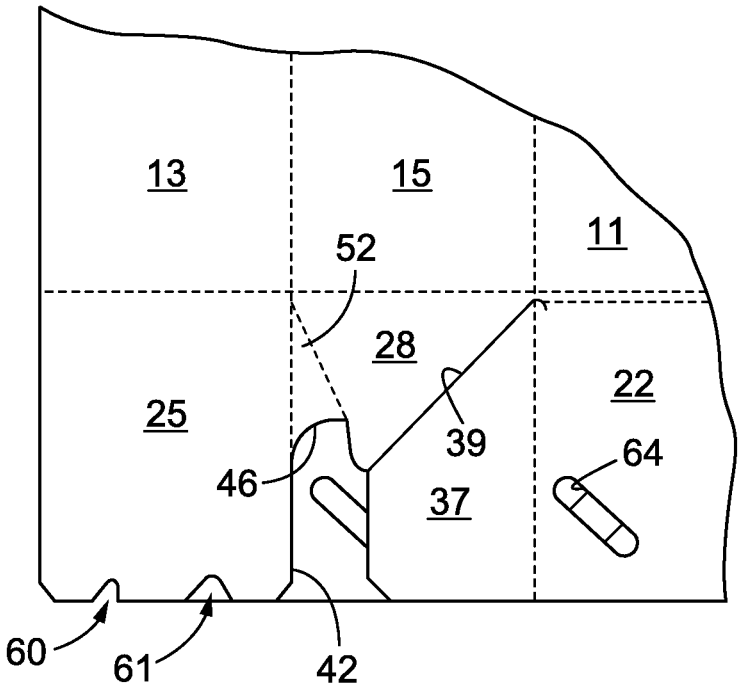
FIG. 6 is a fragmentary plan view showing the blank of FIG. 4 folded in half into a flattened condition for shipment to a user.

As seen best in FIG. 5, the shaped cut-outs 42 terminate at their inner end in a curvilinear configuration that delineates an end edge 46 of the diagonal flap, and the angled cut 39 delineates one side edge 47. The other side edge 48 of the diagonal flap is integrally connected to the adjacent minor flap 25 along a first fold score 49 that is in alignment with the vertical fold 20 joining the associated end wall 13 and diagonal panel 15. A second fold score 50 extends at an angle of about 22.5° relative to the first fold score 49, from a point on the first fold score 49 near but spaced from fold score 27, to the apex of the curved end edge 46. It will be noted that end edge 46 includes a first edge portion 46A extending in general alignment with fold score 50, and terminating in an end 51 that connects to the juncture of edge portions 40 and 43 at an angle that substantially bisects the included angle between edge portions 40 and 43. The end edge 46 includes a second, arcuate edge portion 46B extending between the ends of fold scores 49 and 50, with one end of the arcuate edge extending substantially perpendicular to the fold score 50, and the other end of the arcuate edge extending substantially tangentially to the fold score 49. The fold scores 49 and 50 define a web 52 that connects the diagonal flap with the minor flap.

The area A1 of diagonal flap 28 bounded by edges 46A and 47 and folds 32 and 50 preferably is lightly crushed as indicated by the diagonal cross-hatching, and a second area A2 bounded by fold score 50 in diagonal flap 28 and arcuate edge 53 lying in minor flap 25 is more heavily crushed, as indicated by more closely spaced cross-hatching. Since the machinery used to crush the panels is normally set to deliver a constant force, different degrees of crushing are obtained by using harder or softer press or die elements. Thus, in the present invention the more lightly crushed areas are crushed by using gray sponge rubber elements and the more heavily crushed areas are crushed by using dieprene rubber elements. These shaped crushed areas provide clearance for the overlapped material when the container is in its operative folded position, providing a flatter, more compact fold. Further, the fold score 49 and fold line 50, and especially the crushed area A2, with its arched edge 53, ensure proper operation of the web 52 and prevent propagation of false folds in the panels as the container is being folded into its operative position.

When lighter materials are used, such as, e.g., single wall or lighter double wall, crushing of area A1 can be omitted and suitable performance still obtained. Moreover, a separate fold score 50 need not be formed by a die blade, but instead the line of transition between the heavily crushed area A2 and the more lightly crushed or non-crushed area A1 can be relied upon for forming a fold line about which the material will fold.

The placement and radius of arcuate edge 53 is determined by drawing an imaginary line 54 that is a mirror image of fold score 50, then drawing a second line 55 parallel to and spaced from line 54 a distance calculated to account for manufacturing tolerances, and swinging an arc (edge 53) that connects the three points defined by the intersection of one end of line 55 with fold 27, the opposite end of line 55, and the point at or near where the fold score 49 terminates at edge 46.

With particular reference to FIGS. 4 and 5, it will be noted that the shaped cut 45 at the end of cut 39, and the point of intersection of fold lines 50 and 49, are spaced a short distance "d" from the respective horizontal folds 24 and 27. This spacing is to accommodate manufacturing tolerances and is to ensure that the cut, especially, will not extend into the panel 11. The crushed areas A1 and A2 preferably do not extend beyond the folds 27 and 32.

A self-locking structure for holding the bottom flaps in closed position is defined by a pair of triangularly shaped notches 60 and 61 in the free edge of each of the minor bottom flaps, defining a pair of locking tabs 62 and 63 on the corners of the minor bottom flaps, and by a pair of angled slots 64 and 65 formed in the major bottom flaps near their free edge in a position to receive the locking tabs when the major and minor bottom flaps are folded inwardly over the bottom of the container. To enhance the ease of setting up the container, the edges of the slots facing toward the centerline of the flap may be crushed as indicated at 72.

In those containers where the major flaps are intended to overlap when in their inwardly folded position, as in FIGS. 4-11, one of the notches 61 is shaped differently than the other notch 60. That is, the side edges 66 and 67 lying closest to the respective adjacent side edges of the flap in both notches 60 and 61 extend at an angle of about 60° relative to the free end edge of the flap, but the side edge 68 lying closest to the center of the flap in notch 60 extends substantially perpendicular to the free end edge of the flap, defining an inner shoulder 69, whereas the side edge 70 of notch 61 extends at an angle of about 45° relative to the free end edge of the flap, defining an inner shoulder 71 that is spaced closer to the centerline of the flap than is shoulder 69. Thus, when the minor flap is pushed downwardly against a pair of opposed major flaps during set up of the container to engage the locking tabs in the slots, and pressure is then released to permit the flaps to spring back up to a generally horizontal position, the shoulder 69 will hold the major flap it engages down farther than will the shoulder 71 hold its associated major flap down. Stated differently, the shoulder 71 is effectively cut away, providing clearance for the major flap engaged thereby to enable that flap to move farther upwardly when downward pressure on the minor flap is released, permitting that major flap to overlie the opposed major flap as they return to a horizontal position. See FIGS. 8-10.

It should be understood that the particular angles of the sides of the respective notches are not critical and the sides of the notches can be oriented at any angle, so long as the inner shoulder of one notch is spaced farther from the flap centerline than is the inner shoulder of the other notch in that flap, whereby the inner shoulders of the notches on one side of the centerline of opposed minor flaps will engage and hold down the associated first major flap while the inner shoulders of the other notches in the minor flaps, being spaced closer to the flap centerline, will provide clearance to permit the associated second major flap to at least initially move up farther than the first major flap so that the major flaps will move into overlapping relationship as they approach horizontal positions. Moreover, some shape other than V-shaped notches may be used. The essential point is that one major flap is permitted to initially move up more than the other major flap so that they overlap at their adjacent free edges as they approach their operative folded horizontal positions.

Figure 12:
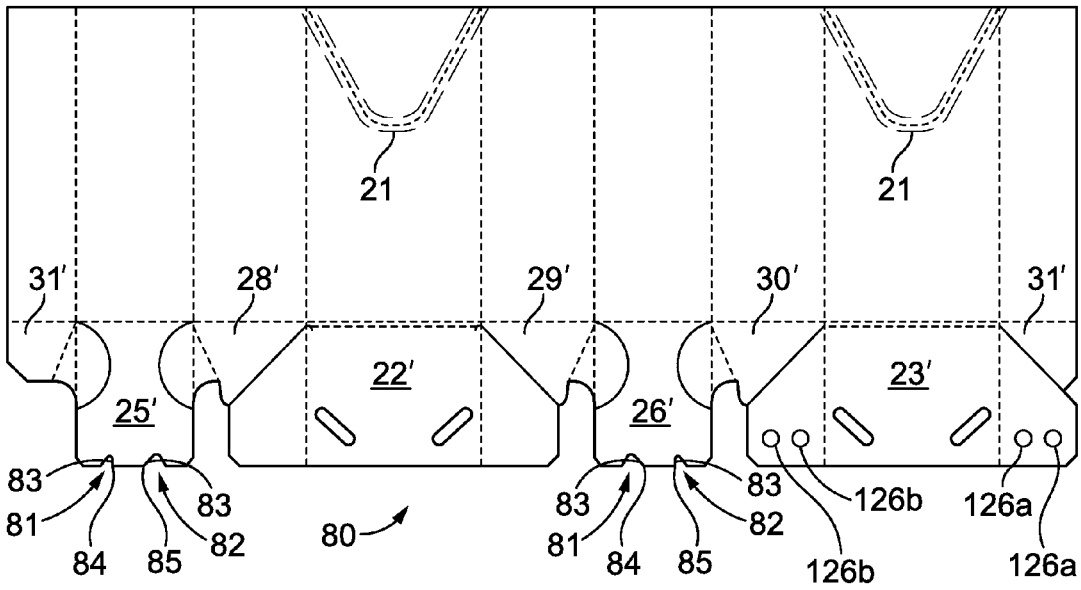
FIG. 12 is a top plan view of a blank having an alternative embodiment of die-cut self-lock feature, wherein the combination hole and slit of FIG. 4 is replaced by two pairs of holes formed in one of the major flaps for tying the plastic bag thereto for making an alternate embodiment of the container of the invention, and wherein the major bottom flaps do not overlap and the notches in the edge of the minor flaps are identically shaped.

FIG. 12 is a top plan view of a blank 80 having an alternate embodiment of die-cut self-lock feature that comprises two adjacent holes 126*a* in one of the extensions 38 and two adjacent holes 126*b* in the other extension 37 at opposite sides of one of the major bottom flaps 23' for attaching the plastic bag 120 to the bottom of the container. In this form of the invention the major bottom flaps do not overlap and the notches in the edge of the minor flaps are identically shaped. To attach the bottom of the bag 120 to the bottom of the container 10, one corner of the bag 120 is inserted through one of the holes 126*a* and then passed back through the adjacent hole 126*a* and tied behind the web formed between the two holes 126*a*, 126*a*. Similarly, the opposite corner of the bag 120 is inserted through one of the holes 126*b* and passed back through the adjacent holes 126*b* and tied behind the web formed between the two holes 126*b*, 126*b*.

Figure 13:
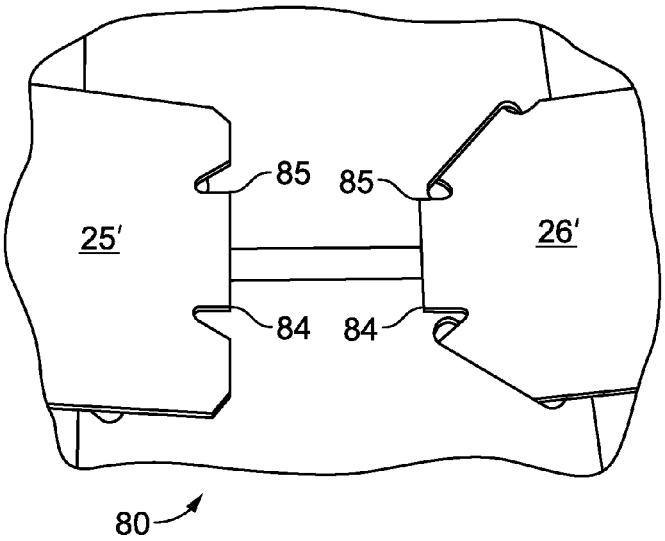
FIG. 13 is a fragmentary bottom view of a container made from the blank of FIG. 12, showing how the minor flaps and notches are constructed to react equally against the two major flaps.

FIGS. 12 and 13 also show an embodiment of blank 80 in which the bottom flaps 22', 23', 25', 26' and 28'-31' are not as wide as in the previous embodiment and the major bottom flaps 22' and 23' are not intended to overlap, but instead butt against one another at their free edges when they are in their inwardly folded horizontal positions. Except for the difference between the die-cut self-lock features used in this embodiment of blank and the blank shown in FIG. 4, this form of container is identical to the form shown in FIG. 4 except for the difference in width of the bottom flaps and except that both notches 81 and 82 in the free edge of the minor flaps are identical to one another. Thus, the edge 83 of both notches extends substantially perpendicular to the free edge of the flap, and the shoulders 84 and 85 are spaced equally from the center of the flap, whereby the shoulders act to exert substantially equal downward pressure on the major flaps when the box is being set up, and provide substantially equal clearance for return of the major flaps to an upper, horizontal position when pressure is released.

Figure 14:
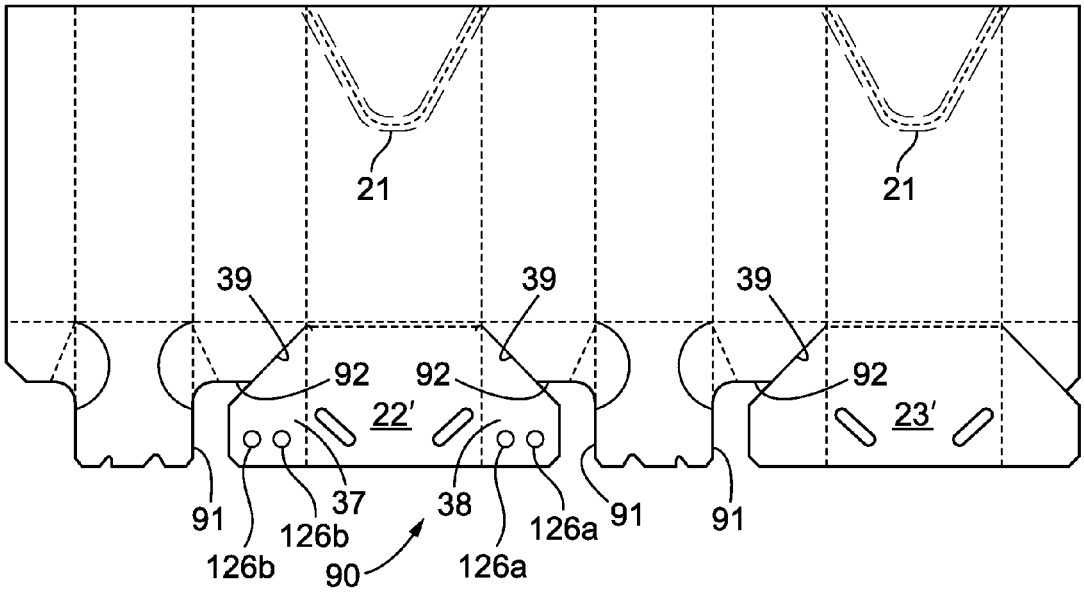
FIG. 14 is a plan view of an alternate embodiment of a blank that varies from that shown in FIG. 12 in that the die-cut self-lock feature comprising two adjacent holes is formed in the opposite major bottom panel and wherein the cut-outs between the major and minor flaps have a different terminal end shape.

A further embodiment of blank with which the present invention can be associated is indicated at 90 in FIG. 14. In this embodiment, the same type of die-cut self-lock feature is used as shown in the FIG. 12 embodiment, i.e. two adjacent holes 126*a* are formed in one of the extensions 38 and two adjacent holes 126*b* are formed in the other extension 37. However, it will be noted that the holes are formed in the major flap 22' rather than the flap 23' as in the previous embodiment. Also, the cut-outs between the major and minor flaps are shaped slightly differently in that the cut-outs each extend at one side a short distance along the diagonal cut 39, forming a "nose" 92 on the end of the respective cut-out at the end edge of the diagonal flap. The manner in which the bag 120 is attached to the container is the same as described above with respect to FIG. 12 and will not be repeated again to avoid redundancy. This form functions identically to the form shown in FIG. 4, except that due to the extension of the "nose" to one side of the cut-out, the waste material may be more difficult to remove when the cut-out is made. It should be understood that this form could be applied to a container in which the major bottom flaps do not overlap, in which case the bottom flaps would be made narrower, and the notches in the ends of the minor flaps could be shaped identically to one another as shown in FIG. 12.

Figure 15:
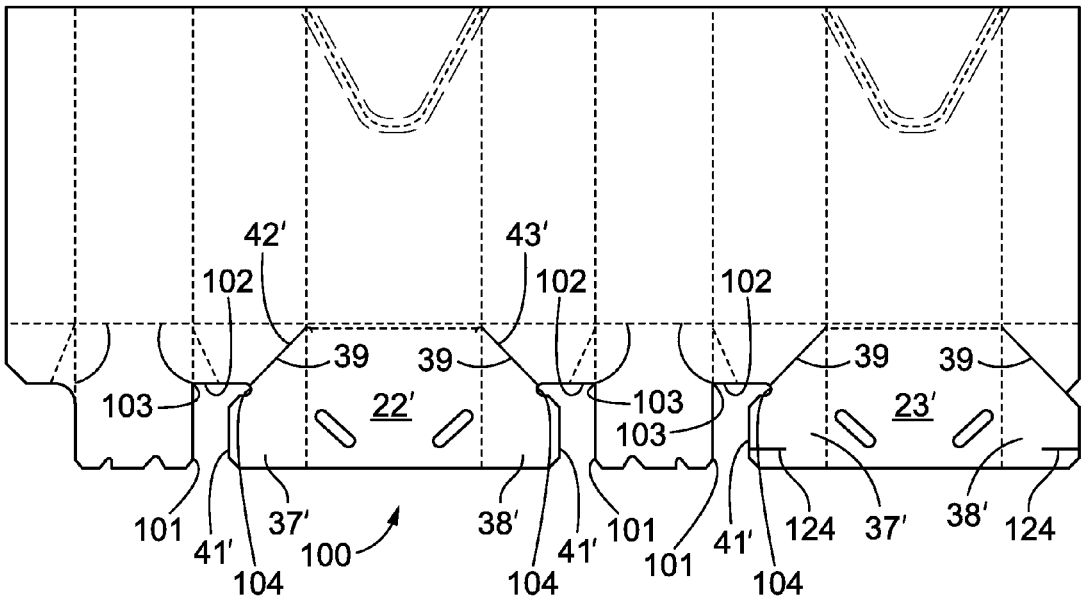
FIG. 15 is a plan view of a further alternate embodiment of a blank that varies from that shown in FIG. 12 in that the die-cut self-lock feature comprises slits extending into the outer side edges of the flap extensions at opposite side edges of a major bottom flap, and the flaps are designed for making a container having non-overlapping bottom flaps, with symmetrically shaped notches in the ends of the minor flaps, and wherein the cut-outs between the major and minor flaps have yet another different terminal end shape.
Figure 16:
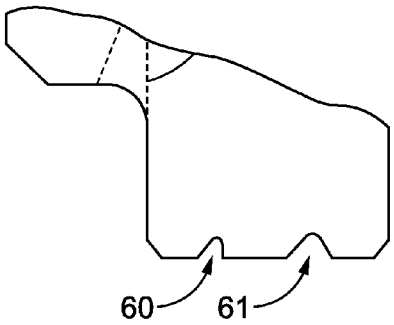
FIG. 16 is an enlarged fragmentary plan view of a portion of a blank as shown in FIG. 15, depicting a modification thereof in which the notches in the minor flaps are non-symmetrical for containers with overlapping bottom flaps.

Another embodiment of the invention is shown at 100 in FIG. 15, wherein the die-cut self-lock feature comprises slits 124 extending inwardly into the outer side edges of the extensions 37' and 38' on opposite side edges of the major bottom flap 23'. Alternatively, the slits may be formed in major flap 22' rather than flap 23'. The blank shown in FIG. 15 also differs from that previously shown in that the container has non-overlapping bottom flaps, with symmetrically shaped notches in the ends of the minor flaps, and wherein the cut-outs 101 between the major and minor flaps have a different terminal end shape. The cut-outs 101 are formed essentially of straight lines and form a straight edge 102 on the end of the diagonal flap. At one end this edge intersects the side edge of the minor flap at a right angle 103, and at the other end the edge 102 extends slightly beyond the edge 41' of the major flap, forming a "toe" 104 that protrudes slightly into the edges 42' and 43' of extensions 37' and 38' at the terminal end of diagonal cut 39. This form functions substantially identically to the form shown in FIG. 12, except that the piece of waste material formed by making the cut-out 101 may be harder to remove, and the straight lines and sharp angles are more likely to establish stress points where tearing or propagation of false fold lines (buckling) can occur. This container could be adapted to one in which the major bottom flaps overlap by making the flaps wider, and, if desired, shaping the notches in the end edge of the minor flaps asymmetrically as shown in FIGS. 4 and 16.

Figure 17:
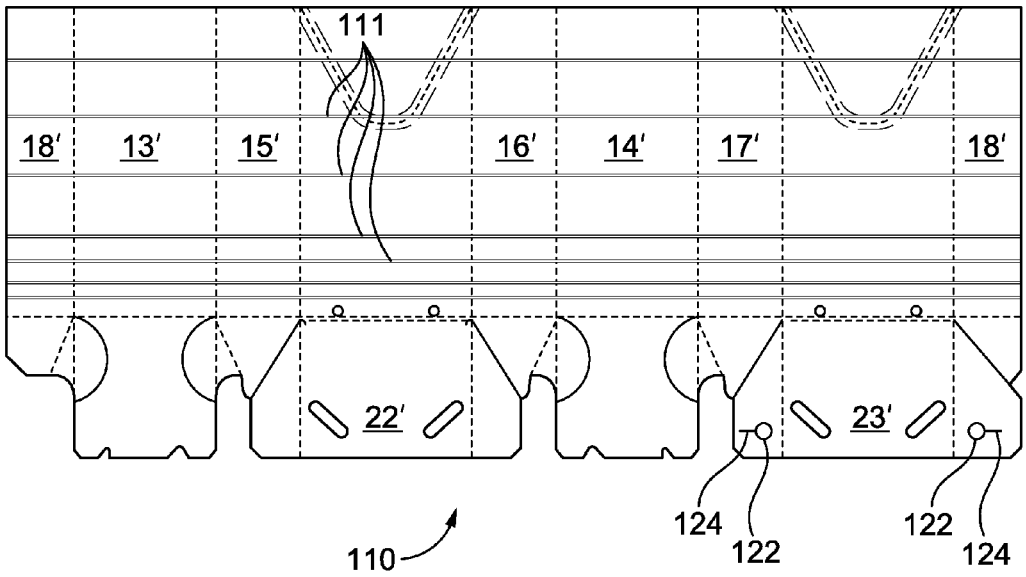
FIG. 17 is a top plan view of a blank having the combination of a hole and a slit as the die-cut self-lock feature such as shown in FIG. 12, and a bottom flap construction as shown in FIG. 4, but wherein the diagonal corner panels are of less width than the end walls, and wherein reinforcing tapes or straps are shown applied to the container.

FIG. 17 shows an embodiment 110 in which the end wall panels 13' and 14' have a greater width than the diagonal corner panels 15'-18'. This embodiment incorporates a die-cut self-lock feature comprising a combination of a hole 122 and slot 124 formed in the major bottom flap 23' as in the FIG. 4 embodiment. The bottom flap construction is the same as shown in FIG. 4, except the diagonal corner panels are of less width than the end walls, and reinforcing tapes or straps 111 are applied to the container. In all other respects, except for differences in the side-to-side dimensions of the bottom flaps resulting from differences in the sidewall, end wall and diagonal corner panel widths, this form of the invention is identical to the form shown in FIG. 4. The reinforcing tape 111 can be applied, or not, to any of the forms of the invention.

To erect the container, and with reference first to that form of the die-cut self-lock feature according to the invention shown in FIGS. 4 and 17, the container is placed in an inverted position with its bottom end up as seen in FIGS. 18A, 18B, 20A and 20B. If desired, to aid in squaring up the container and to prevent contamination of the top end of the container, the inverted container may be placed on a plastic pallet (not shown herein but shown at 100 in applicant's prior U.S. Pat. No. 7,681,781). To attach the bottom of the bag 120 to the bulk container 10 according to the form of the invention shown in FIGS. 4 and 17, and with particular reference to FIGS. 19, 20A, 20B, 20C and 20D, the corners of the bag 120 are inserted through respective holes 122 and pulled into the associated slit 124 formed in the major flap 23 to securely attach the bag to the container.

Figure 18A:
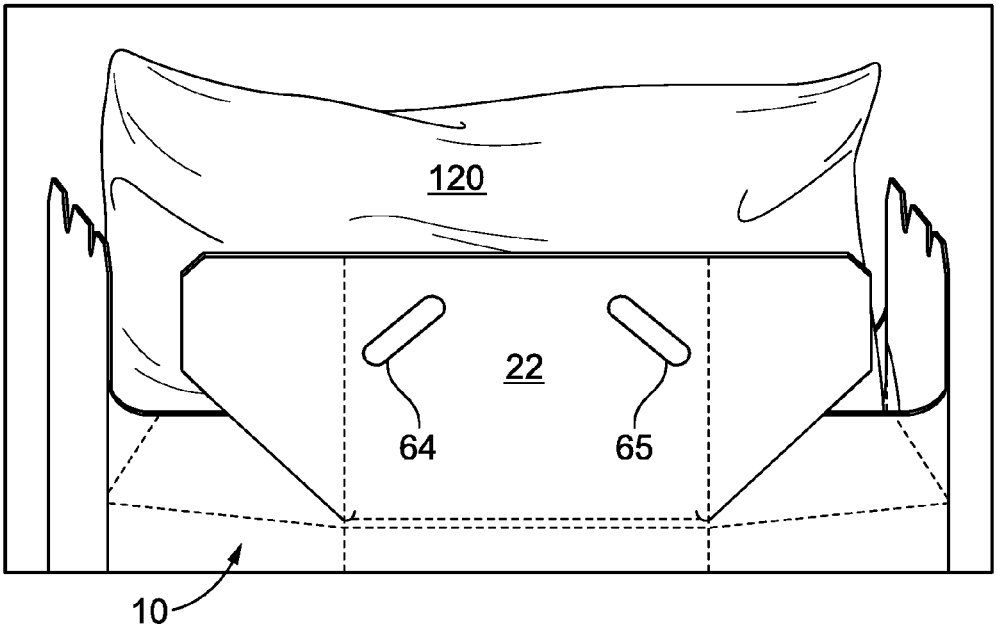
FIG. 18A is a fragmentary view illustrating the container in an inverted position with the bottom corners of the plastic bag liner held preparatory to being inserted into the respective slits of the die-cut self-lock feature as shown in FIG. 15 in one of the major flaps.
Figure 18B:
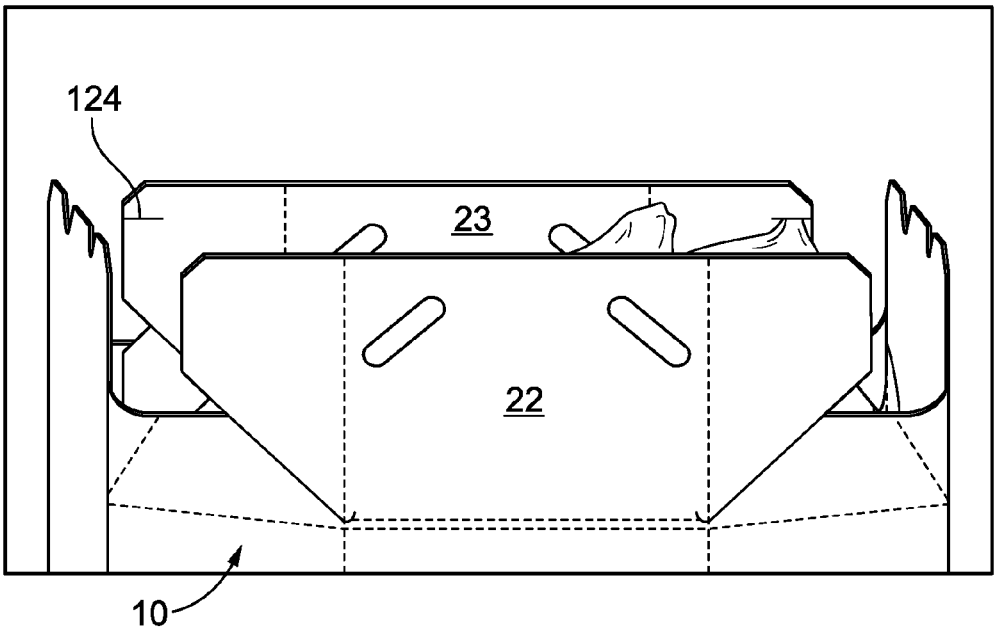
FIG. 18B is similar to FIG. 18*a* and illustrates the manner in which the bottom corners of the plastic bag liner are inserted into the slits.
Figure 19:
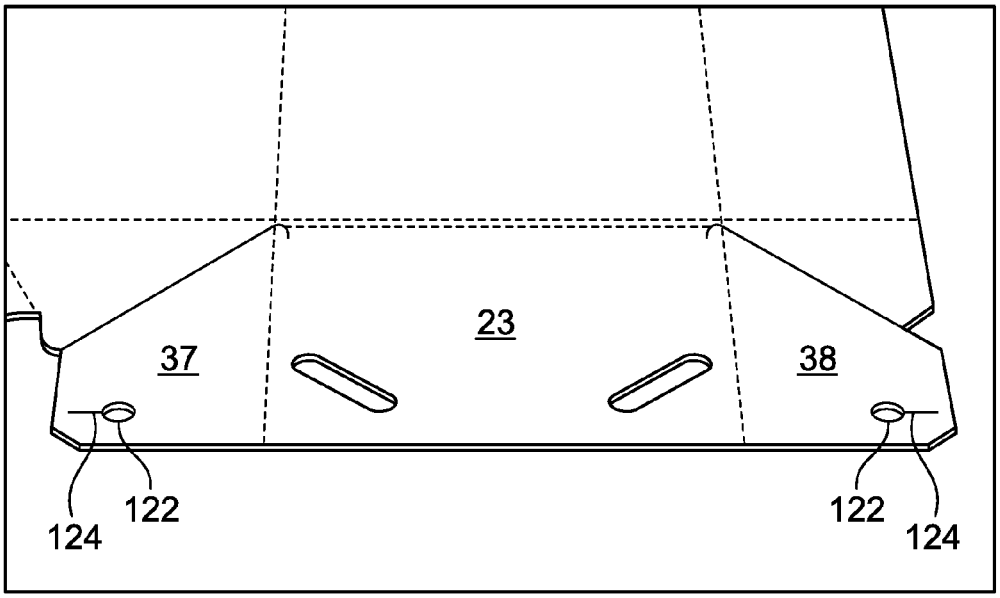
FIG. 19 is a fragmentary top perspective view of one of major flaps having the combination of a hole and a slit as the die-cut self-lock feature formed in the respective longitudinal corners of a major bottom flap according to one embodiment of the invention.
Figure 20A:
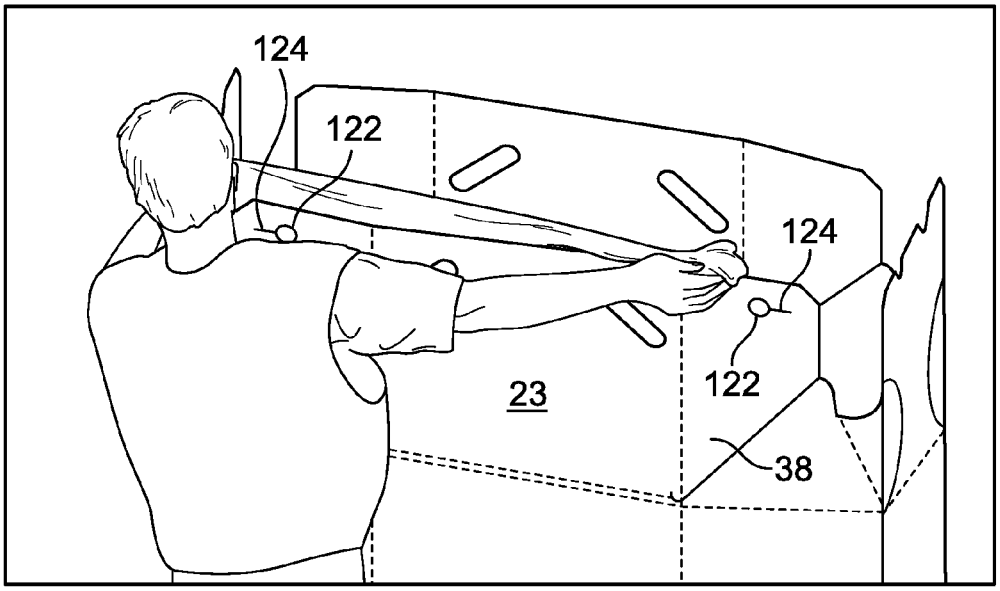
FIG. 20A illustrates the bottom corners of the bag liner being held preparatory to being inserted into the respective combination holes and slits of that embodiment of die-cut self-lock feature shown in FIGS. 4, 17 and 19.
Figure 20B:
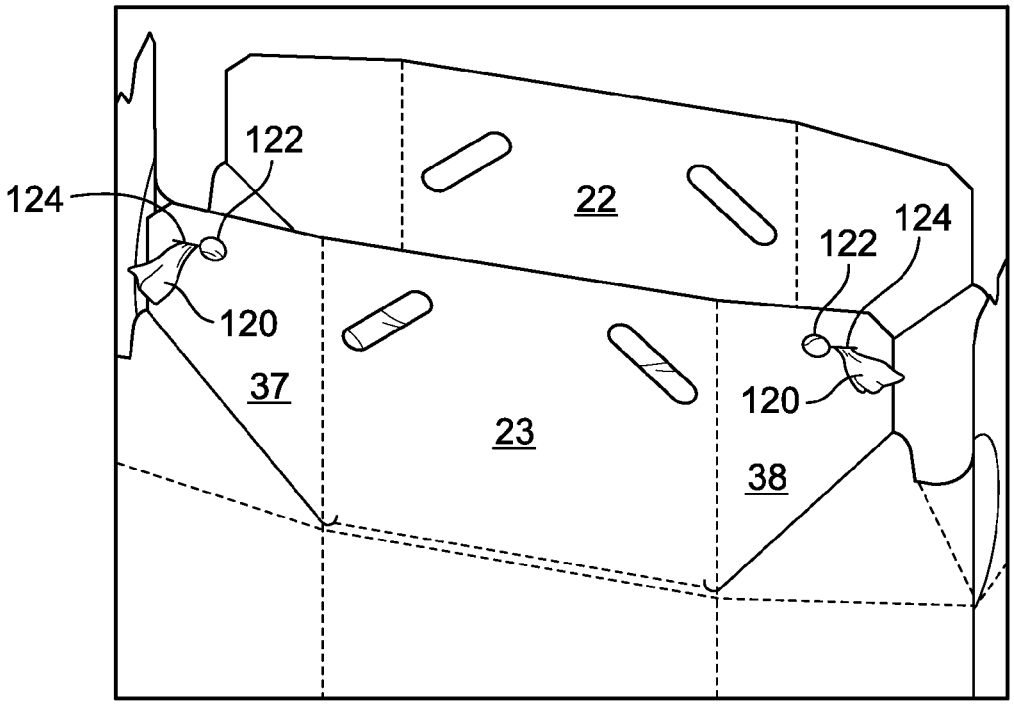
FIG. 20B shows a further step of assembling the bag liner to the container of FIG. 20A, wherein the corners of the bag have been inserted through the holes and pulled into the slits to secure the bottom of the bag to the associated major bottom flap.
Figure 20C:
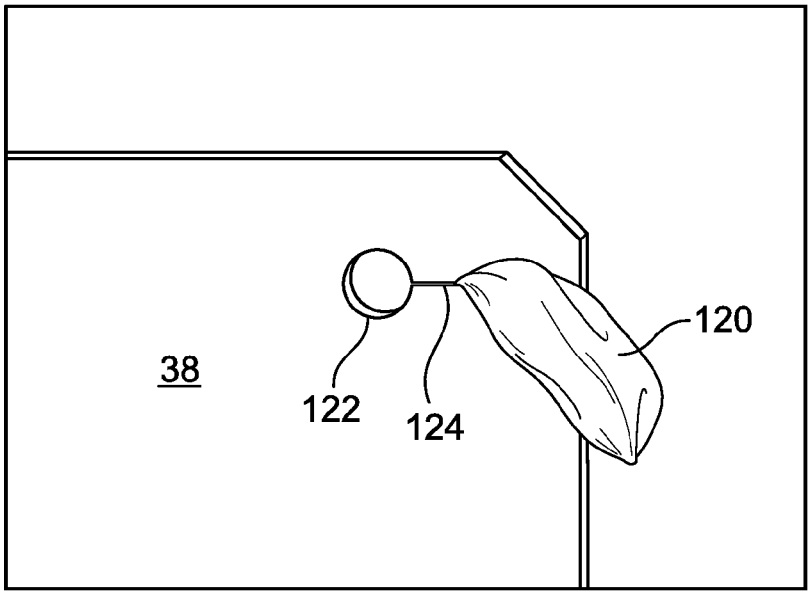
FIGS. 20C and 20D are fragmentary enlarged close up views showing the corners of the bag liner pulled into one of the slits extending from one side of the hole.
Figure 20D:
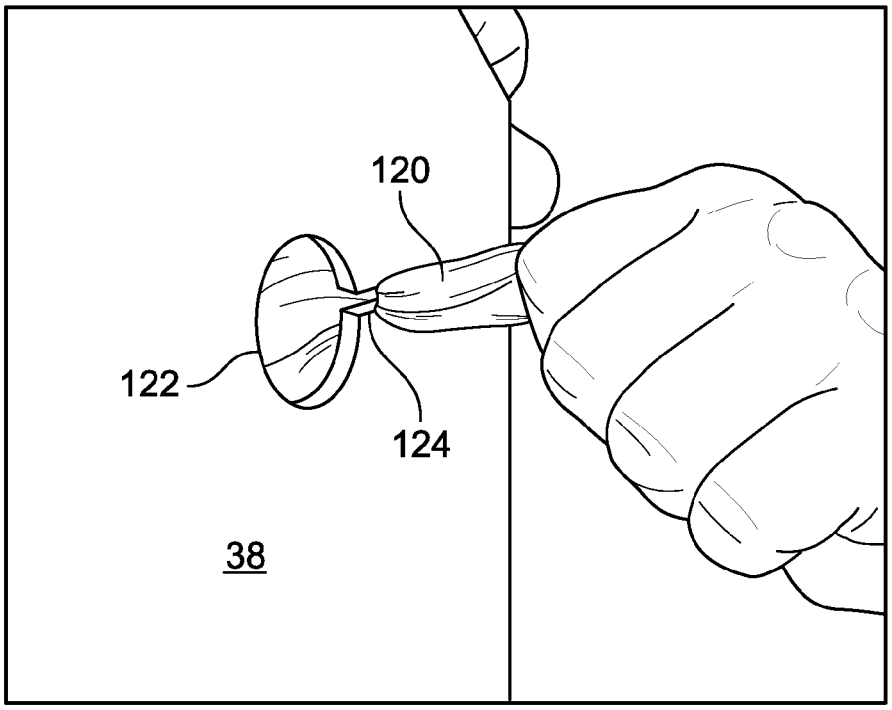

In that form of the invention shown in FIG. 18B, the die-cut self-lock feature comprises the slit 124 as shown in FIG. 15, extending into the outer side edges of the extensions 37 and 38 on opposite side edges of the major bottom flap 23. To attach the bag liner to the container, the opposite corners at the ends of the bottom seam are simply pulled into the slits, thereby securing the corners to opposite ends of the bottom flap.

Figure 21:
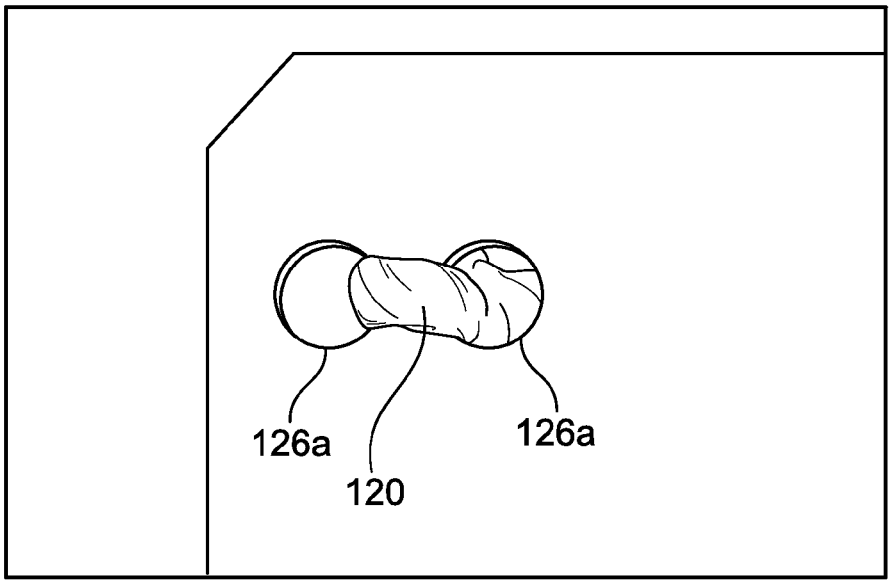
FIG. 21 is an enlarged fragmentary view of a portion of one of the major flaps wherein the die-cut self-lock feature comprises two holes as shown in that embodiment in FIG. 12, and depicting a corner of the bag liner inserted through one hole and back through the other.
Figure 22:
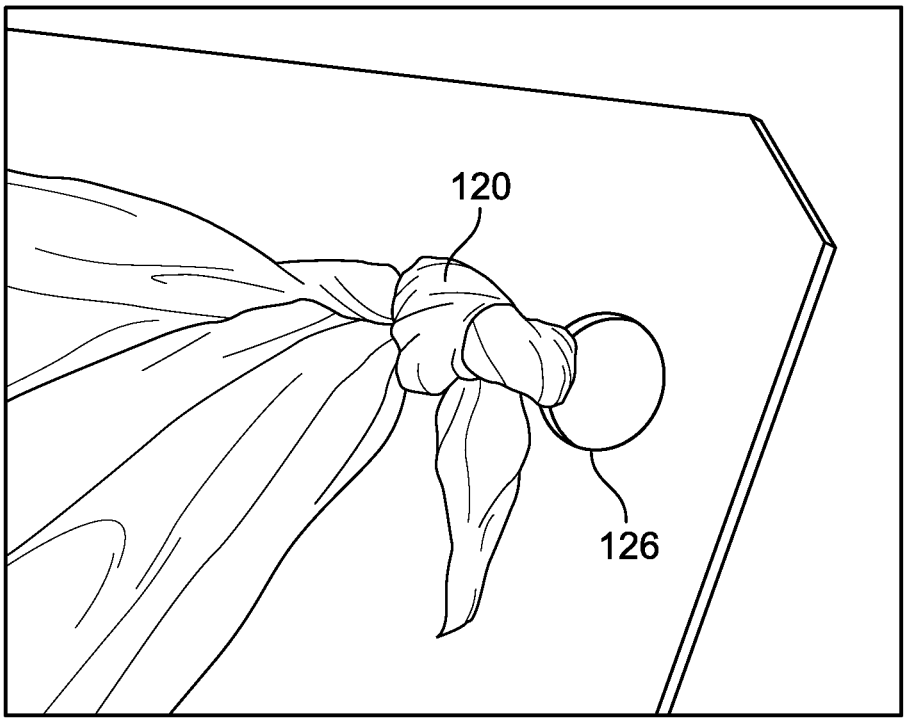
FIG. 22 is an enlarged fragmentary view of the opposite side of the flap shown in FIG. 21, showing how the corners of the bag liner are tied to prevent their withdrawal from the holes.
Figure 23:
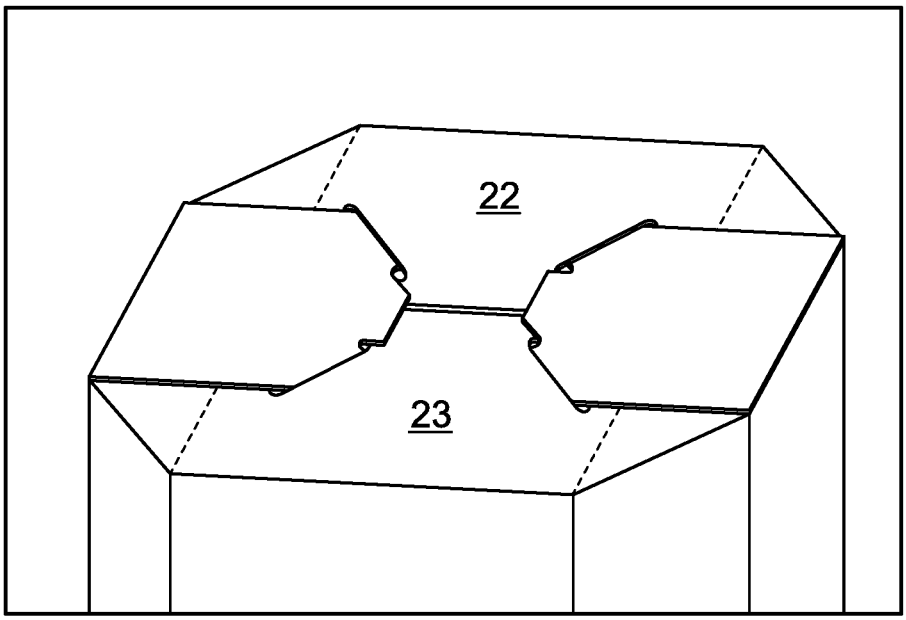
FIG. 23 is a fragmentary perspective view of the bottom of the inverted bulk container in FIG. 1, showing the major flaps and minor flaps in interlocked positions.
Figure 24A:
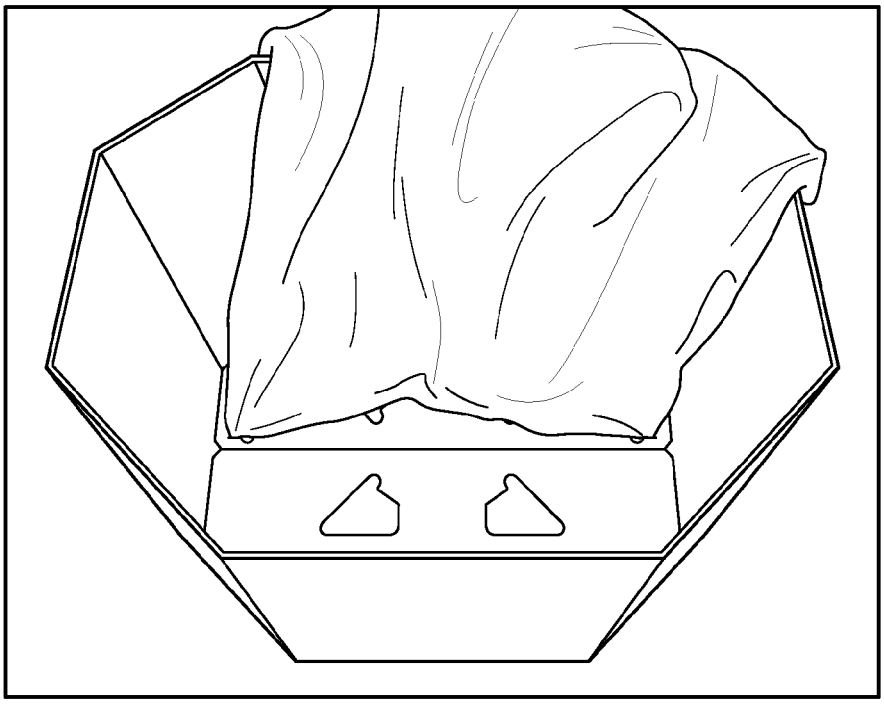
FIG. 24A is a top perspective view of the interior of the container placed in an upright position, showing the opposite corners of the bottom of the plastic bag liner attached to opposite sides of the bottom of the bulk container.
Figure 24B:
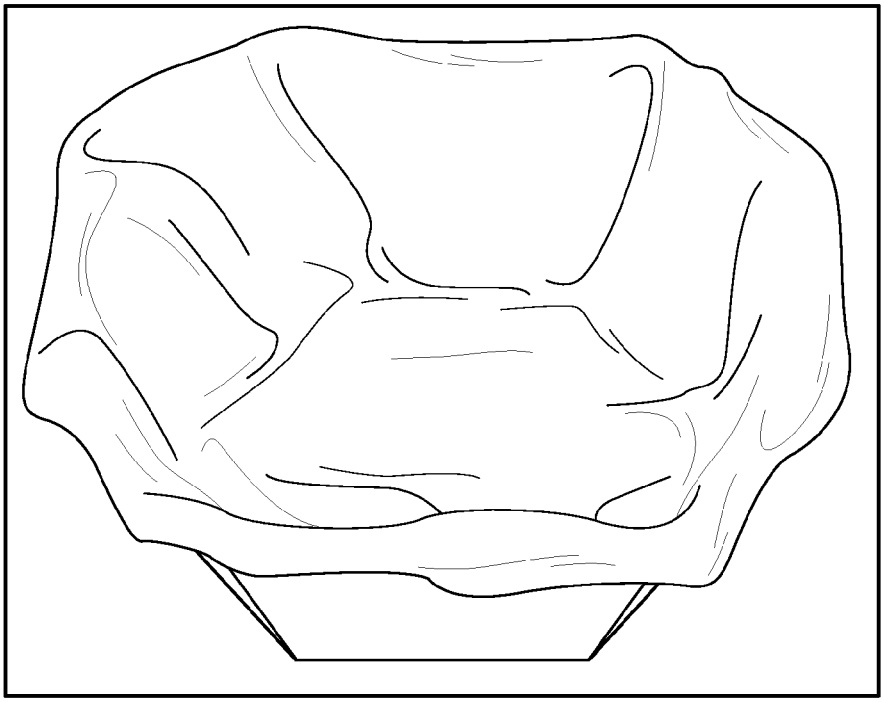
FIG. 24*b* is a top perspective view of the container of FIG. 24A, showing the plastic bag liner opened up to receive the product.

FIGS. 21 and 22 depict the manner of attaching the bag to the container wherein the die-cut self-lock feature comprises a pair of closely adjacent holes 126*a* and 126*a* in one of the extensions 38 and a pair of adjacent holes 126*b*, 126*b* in the other extension 37, as shown in the FIGS. 12 and 14 embodiments. In this form of the invention the corners of the bag at opposite ends of the bottom seam are inserted through one of the holes in a respective pair and back through the adjacent hole and tied at the back of the web formed between the holes in each pair, thus securing the bottom of the bag to the bottom of the container.

Figure 7:
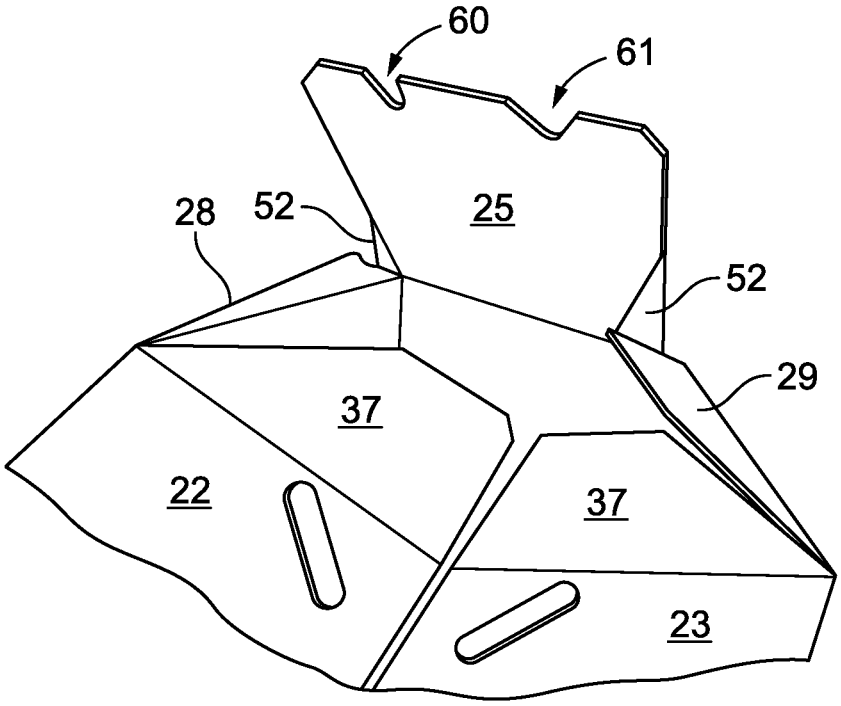
FIG. 7 is an enlarged fragmentary perspective view of the bottom end of an inverted container made from the blank of FIG. 4, showing the major flaps folded inwardly and one of the minor flaps and associated diagonal flaps being folded.
Figure 8:
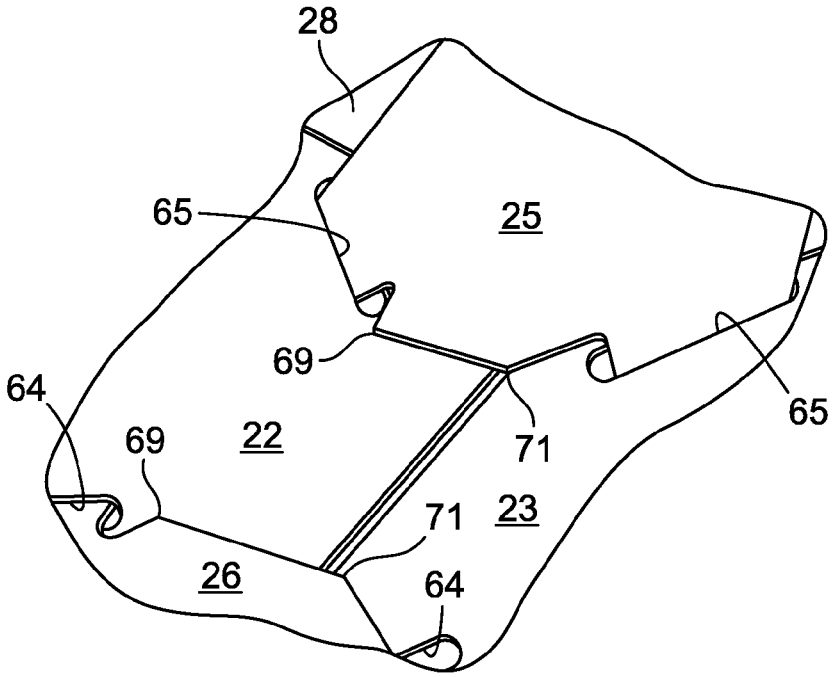
FIG. 8 is a further enlarged fragmentary perspective view of the container of FIG. 7, showing how the minor flaps engage the major flaps during set up to insert the locking tabs into the slots, and illustrating how the shaped notches in the minor flaps act to provide clearance for one of the major flaps so that that flap can rise above the other flap.
Figure 9:
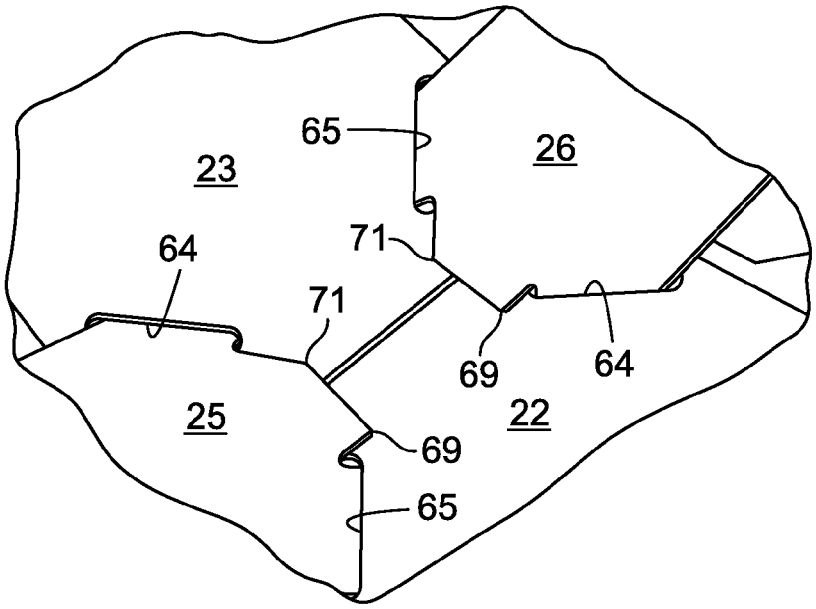
FIG. 9 is a view similar to FIG. 8, looking from the opposite side of the container, and showing a further stage of the container being set up, wherein one of the major bottom flaps is beginning to overlie the other as the flaps move toward a generally horizontal position.
Figure 10:
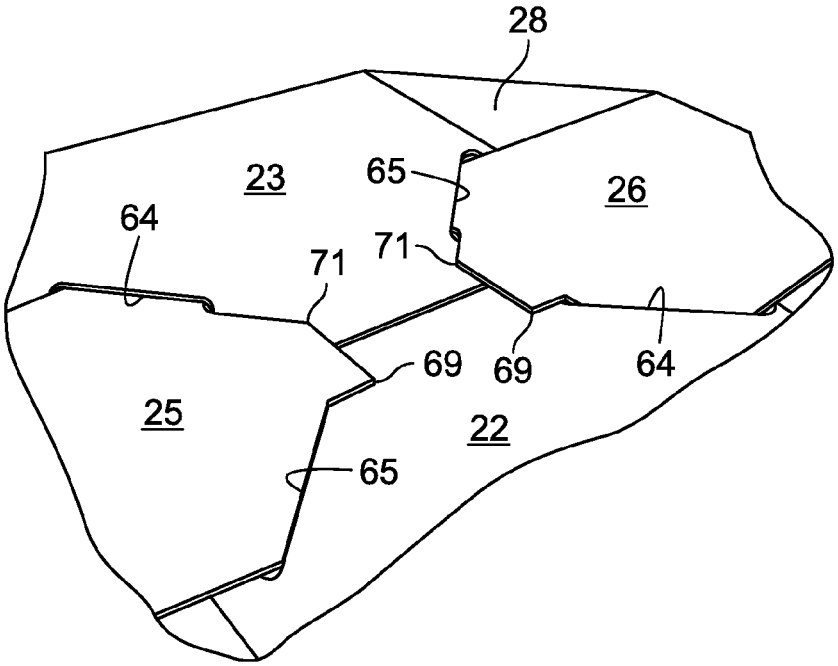
FIG. 10 is an enlarged fragmentary bottom perspective view of the container of FIG. 9, with the flaps in their operative, overlapped horizontal position.

The container is then erected into its set-up configuration by first folding the major bottom flaps 22 and 23 inwardly as seen in FIG. 7, followed by inward folding of the minor bottom flaps 25 and 26. The minor flaps are then pressed downwardly against the major flaps, causing the major flaps to move downwardly slightly into the container to bring the locking tabs 62 and 63 into aligned registry with the slots 64 and 65. When downward pressure is released, the flaps spring back upwardly, with the tabs extending into the slots to interlock the flaps together in a generally horizontal position closing the bottom of the container, as seen in FIG. 10. Inward folding of the major flaps is easily accomplished since they are free of connection with adjacent flaps, and inward folding of the minor flaps causes the diagonal flaps to automatically fold inwardly so that they are sandwiched between the major and minor flaps in a fully set up container. Further, and as previously described, in a container having overlapping bottom flaps the differently shaped notches in the end edge of the minor flaps causes one of the opposed major flaps to be held down slightly more than the other so that the flaps can easily move into overlapping relationship as they approach their horizontal positions.

Bulk containers having shapes other than an octagonal shape, such as a rectangular shape or a cylindrical drum, and that have bag liners, could incorporate attaching means in the bottom of the container, including attaching means such as holes or slits or a combination of holes and slits like those disclosed herein, or tape or double face tape or adhesive, and the like, for securing the bottom of the liner to the bottom of the container to prevent it from following product out of the container when the container is inverted and the product dumped out While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A bulk container for shipping product in bulk from one location to another location, wherein the container is polygonal in transverse cross section and has opposed sidewalls, opposed end walls, a top end and a bottom end and comprises:

a sidewall having a top end and a bottom end;

bottom closure means at the bottom end of the sidewall closing the bottom end of the container wherein the bottom closure means comprises opposed bottom flaps joined to bottom ends of respective sidewalls and end walls;

a bag liner in the container, said bag liner having a top end at the top end of the container and a bottom end at the bottom end of the container; and attaching means on the bottom closure means for attaching the bottom end of the bag liner to the bottom end of the container so that the bag liner remains in the container when the container is inverted and product is dumped from the container wherein the attaching means comprises a hole in each end of one of said bottom flaps and a slit extending into one side of each respective hole, opposite corners of the bag liner being inserted through a respective hole and pulled into an associated slot to attach the bottom of the bag liner to the bottom of the container.

2. The bulk container of claim 1, wherein:

said bottom flaps comprise major bottom flaps and minor bottom flaps, said attaching means being formed in opposite ends of one of said major bottom flaps.

3. The bulk container of claim 2, wherein:

diagonal corner panels are interposed between adjacent sidewalls and end walls; and diagonal bottom flaps are foldably attached to bottom ends of the diagonal corner panels.

4. The bulk container of claim 3, wherein:

the major bottom flaps have extensions on opposite ends thereof; and said attaching means are formed in said extensions.

5. A bulk container for shipping product in bulk from one location to another location, wherein the container is polygonal in transverse cross section and has opposed sidewalls, opposed end walls, a top end and a bottom end and comprises:

a sidewall having a top end and a bottom end;

bottom closure means at the bottom end of the sidewall closing the bottom end of the container wherein the bottom closure means comprises opposed bottom flaps joined to bottom ends of the respective sidewalls and end walls;

a bag liner in the container, said bag liner having a top end at the top end of the container and a bottom end at the bottom end of the container; and attaching means on the bottom closure means for attaching the bottom end of the bag liner to the bottom end of the container so that the bag liner remains in the container when the container is inverted and product is dumped from the container wherein the attaching means comprises a pair of closely adjacent holes in each end of one of said bottom flaps, opposite corners of the bag liner being inserted through one hole and back through the adjacent hole and then tied behind the flap to attach the bottom of the bag liner to the bottom of the container.

6. The bulk container of claim 5, wherein:

said bottom flaps comprise major bottom flaps and minor bottom flaps, said attaching means being formed in opposite ends of one of said major bottom flaps.

7. The bulk container of claim 6, wherein:

diagonal corner panels are interposed between adjacent sidewalls and end walls; and diagonal bottom flaps are foldably attached to bottom ends of the diagonal corner panels.

8. The bulk container of claim 7, wherein:

the major bottom flaps have extensions on opposite ends thereof; and said attaching means are formed in said extensions.

9. A bulk container for shipping product in bulk from one location to another location, wherein the container is polygonal in transverse cross section and has opposed sidewalls, opposed end walls, a top end and a bottom end and comprises:

a sidewall having a top end and a bottom end;

bottom closure means at the bottom end of the sidewall closing the bottom end of the container wherein the bottom closure means comprises opposed bottom flaps joined to bottom ends of the respective sidewalls and end walls;

a bag liner in the container, said bag liner having a top end at the top end of the container and a bottom end at the bottom end of the container; and attaching means on the bottom closure means for attaching the bottom end of the bag liner to the bottom end of the container so that the bag liner remains in the container when the container is inverted and product is dumped from the container wherein the attaching means comprises a slit extending into each of opposite side edges of one of the bottom flaps, opposite corners of said bag liner being pulled into a respective slit to attach the bottom of the bag liner to the bottom of the container.

10. The bulk container of claim 9, wherein:

said bottom flaps comprise major bottom flaps and minor bottom flaps, said attaching means being formed in opposite ends of one of said major bottom flaps.

11. The bulk container of claim 10, wherein:

diagonal corner panels are interposed between adjacent sidewalls and end walls; and diagonal bottom flaps are foldably attached to bottom ends of the diagonal corner panels.

12. The bulk container of claim 11, wherein:

the major bottom flaps have extensions on opposite ends thereof; and said attaching means are formed in said extensions.

13. An octagonal bulk container, comprising:

opposite parallel sidewalls, opposite parallel end walls, and diagonal corner panels interposed between respective sidewalls and end walls, said sidewalls and end walls and the diagonal corner panels being joined along vertical folds;

major bottom flaps foldably joined to bottom edges of the respective sidewalls along horizontal folds extending perpendicular to the vertical folds wherein the major bottom flaps have an extension on each of opposite ends thereof;

minor bottom flaps foldably joined to bottom edges of respective end walls along horizontal folds;

diagonal bottom flaps joined to respective diagonal corner panels along horizontal folds;

a bag liner in the container for containing product; and attaching means on one of said major bottom flaps for attaching the bottom end of said liner to the bottom of said container so that the liner remains in the container when the container is inverted and product dumped out and wherein one of said attaching means is formed in each said extension at opposite ends of one of said major bottom flaps.

14. The octagonal bulk container of claim 13, wherein:

each said attaching means comprises a hole and a slit extending into one side of the hole, opposite corners of the bag liner being inserted through a respective hole and pulled into an associated slit to attach the bottom of the bag liner to the bottom of the container.

15. The octagonal bulk container of claim 13, wherein:

each said attaching means comprises a slit extending into one side edge of an associated extension on one of said major bottom flaps, opposite corners of the bag liner being pulled into an associated slit to attach the bottom of the bag liner to the bottom of the container.

16. The octagonal bulk container of claim 13, wherein:

each said attaching means comprises a pair of holes formed in each extension on opposite ends of one of said major bottom flaps, opposite corners of the bag liner being inserted through one hole and back through the adjacent hole and tied to attach the bottom of the bag liner to the bottom of the container.

17. The octagonal bulk container of claim 14, wherein:

the sidewalls have a greater width than the end walls, and the end walls and diagonal walls have the same width, thus reducing the width of the sidewalls and end walls in a container having a comparable capacity, and thereby reducing outward bulge of the sidewalls and end walls.

18. The octagonal bulk container of claim 14, wherein:

the sidewalls have a greater width than the end walls, and the diagonal walls are narrower than the end walls, thus reducing the width of the sidewalls and end walls in a container having a comparable capacity, and thereby reducing outward bulge of the sidewalls and end walls.

19. The octagonal bulk container of claim 17, wherein:

parabolic creases are formed in the sidewalls to obtain predictable and controlled buckling of the sidewalls when internal pressure is applied to the sidewalls by the contents of the container.

20. The octagonal bulk container of claim 19, wherein:

the container is made from a single unitary piece of material;

said major and minor bottom flaps have free edges and are equally wide between their respective horizontal folds and free edges, and have lengths in a side-to-side direction that correspond to the width of a respective associated sidewall or end wall, said minor flaps having opposite side edges aligned with the vertical folds delineating a respective associated end wall, and the major flaps having opposite sides defined by creases aligned with the vertical folds delineating a respective sidewall, whereby the major bottom flaps are longer side-to-side than the minor bottom flaps;

said diagonal bottom flaps have a width between their respective horizontal folds and free edges that is less than about ½ the width of the major and minor flaps;

said extensions are trapezoidally shaped and project laterally from said creases at opposite side edges of the major flaps to an outer free side edge, said extensions being separated from respective adjacent diagonal flaps by cuts extending at about a 45° angle from a point near the intersection of the major flap horizontal folds and a respective crease to a point about midway along an opposite side edge of the major flap extensions, and by shaped cut-outs that space said extension free edges from adjacent side edges of the minor flaps, said free edge portions of said extensions extending parallel to said vertical folds; and said slits of said attaching means extend through a respective adjacent free edge of the respective extension.

21. The octagonal bulk container of claim 20, wherein:

said cuts separating said extensions from adjacent diagonal flaps terminate in a J-shaped hook at their ends adjacent but spaced a slight distance from said horizontal folds and pointing away from both the horizontal and vertical folds, thereby redirecting stress away from the lower end of the vertical folds to avoid initiation of a tear in the vertical fold.

22. The octagonal bulk container of claim 21, wherein:

the length of the extensions between the creases and the free edges, and the shape of the extensions as defined by the cuts and cut-outs, are such that the extensions closely fit in an interior space or corner of said container.

23. A blank for making an octagonal bulk container, comprising:

a single unitary piece of material cut and scored to define a plurality of parallel vertical folds delineating sidewalls, end walls and diagonal corner panels interposed between adjacent sidewalls and end walls;

major bottom flaps joined to bottom edges of said sidewalls by horizontal folds;

minor bottom flaps joined to bottom edges of said end walls by horizontal folds;

diagonal bottom flaps joined to bottom edges of said diagonal corner panels by horizontal folds;

generally trapezoidally shaped extensions on opposite side edges of said major bottom flaps, said extensions having free outer side edges and being separated from an adjacent diagonal bottom flap by a cut extending at about a 45 degree angle to the horizontal fold joining said major bottom flap to an associated sidewall, said cuts terminating in a J-shape at the juncture between said horizontal fold and a said vertical fold at respective opposite sides of a said sidewall, and said extensions being separated from an adjacent minor bottom flap by a shaped cutout;

said diagonal bottom flaps being crushed to facilitate set up of a container erected from said blank;

said major bottom flaps having a pair of spaced slots therein near opposite side edges thereof;

said minor bottom flaps having shaped notches in free edges thereof, defining tabs at opposite corners that extend into said slots in a container erected from said blank; and attaching means formed in the extensions at opposite side edges of one of said major bottom flaps to attach a bottom end of a bag liner in a container erected from said blank to prevent said liner from falling out of a container erected from the blank when the container is inverted during use to dump product from the container.

24. The blank of claim 23, wherein:

said attaching means comprises a hole and a slit extending into one side of the hole, whereby opposite corners of a bag liner can be inserted through a respective hole and pulled into an associated slit to attach the bottom of a bag liner to the bottom of a container erected from the blank.

25. The blank of claim 23, wherein:

said attaching means comprises a pair of holes formed in each extension on opposite ends of one of said major bottom flaps, whereby opposite corners of a bag liner can be inserted through one hole and back through the adjacent hole and tied to attach the bottom of the bag liner to the bottom of a container erected from the blank.

26. The blank of claim 23, wherein:

said attaching means comprises a slit extending into the free outer side edge of the extensions on one of said major bottom flaps, whereby opposite corners of a bag liner placed in a container erected from the blank can be pulled into an associated slit to attach the bottom of the bag liner to the bottom of the container.

* * * * *